US005831527A

United States Patent [19]

Jones, II et al.

[11] Patent Number: 5,831,527

[45] Date of Patent: Nov. 3, 1998

[54] CASINO TABLE SENSOR ALARMS AND METHOD OF USING

[76] Inventors: Griffith Jones, II, 393 Grant St., Phillipsburg, N.J. 08865-3220; Griffith Jones, III, 53 Palmer St., Pawcatuck, Conn. 06379

[21] Appl. No.: 763,767

[22] Filed: Dec. 11, 1996

[51] Int. Cl.[6] ..... G08B 21/00

[52] U.S. Cl. ..... 340/540; 273/138.1; 273/148 R; 340/541; 340/556; 340/562; 340/573; 364/412

[58] Field of Search ..... 340/540, 541, 340/562, 556, 573; 364/412; 273/138.1, 148 R

[56] References Cited

U.S. PATENT DOCUMENTS

| | | | |
|---|---|---|---|
| 4,755,941 | 7/1988 | Bacchi | 364/412 |
| 4,813,675 | 3/1989 | Greenwood | 463/46 |
| 5,283,422 | 2/1994 | Storch et al. | 235/375 |
| 5,299,803 | 4/1994 | Halaby | 273/148 R |
| 5,362,053 | 11/1994 | Miller | 273/148 R |
| 5,377,994 | 1/1995 | Jones | 273/309 |
| 5,406,264 | 4/1995 | Plonsky et al. | 340/572 |
| 5,518,249 | 5/1996 | Sines et al. | 273/304 |
| 5,521,616 | 5/1996 | Capper et al. | 345/156 |

*Primary Examiner*—Glen Swann

*Attorney, Agent, or Firm*—Charles A. Wilkinson; Harris A. Wolin

[57] ABSTRACT

A system of sensors to prevent cheating at a casino gaming table, where the sensors are strategically positioned about a casino gaming table to monitor the movement about certain established areas on the gaming table during certain established times during the play of the game. The tripping of a sensor in response to the detection of unauthorized movement about a certain area of the table sends a signal to a monitoring system which in turn alerts the casino so that the casino may respond to the unauthorized movement accordingly. The system of sensors can be used with a wide variety of card-based or chip-based casino gaming tables.

16 Claims, 10 Drawing Sheets

FIG. 5A
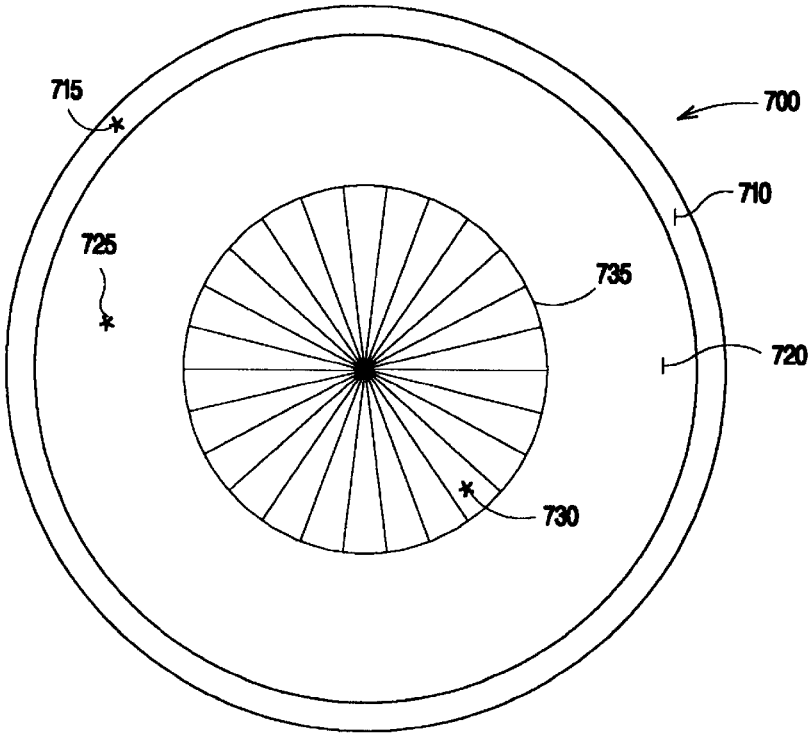
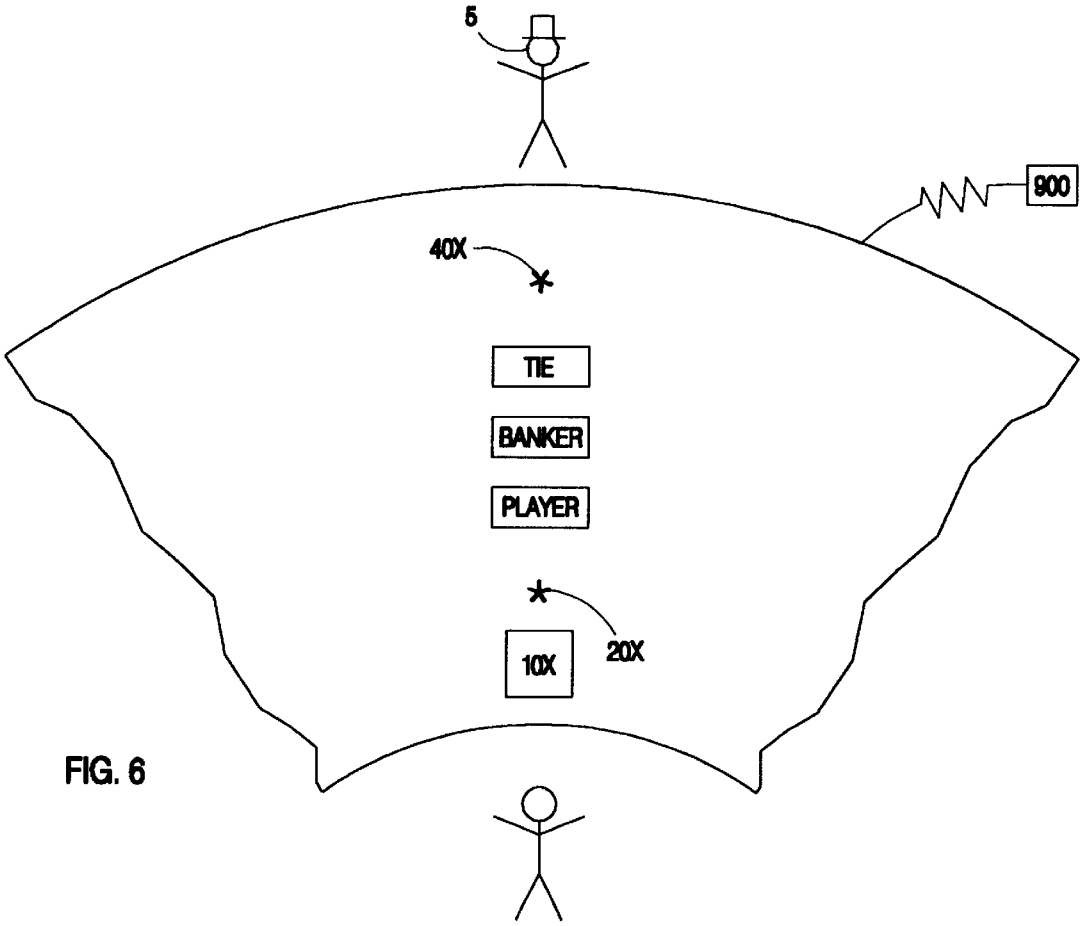
FIG. 6

FIG. 7
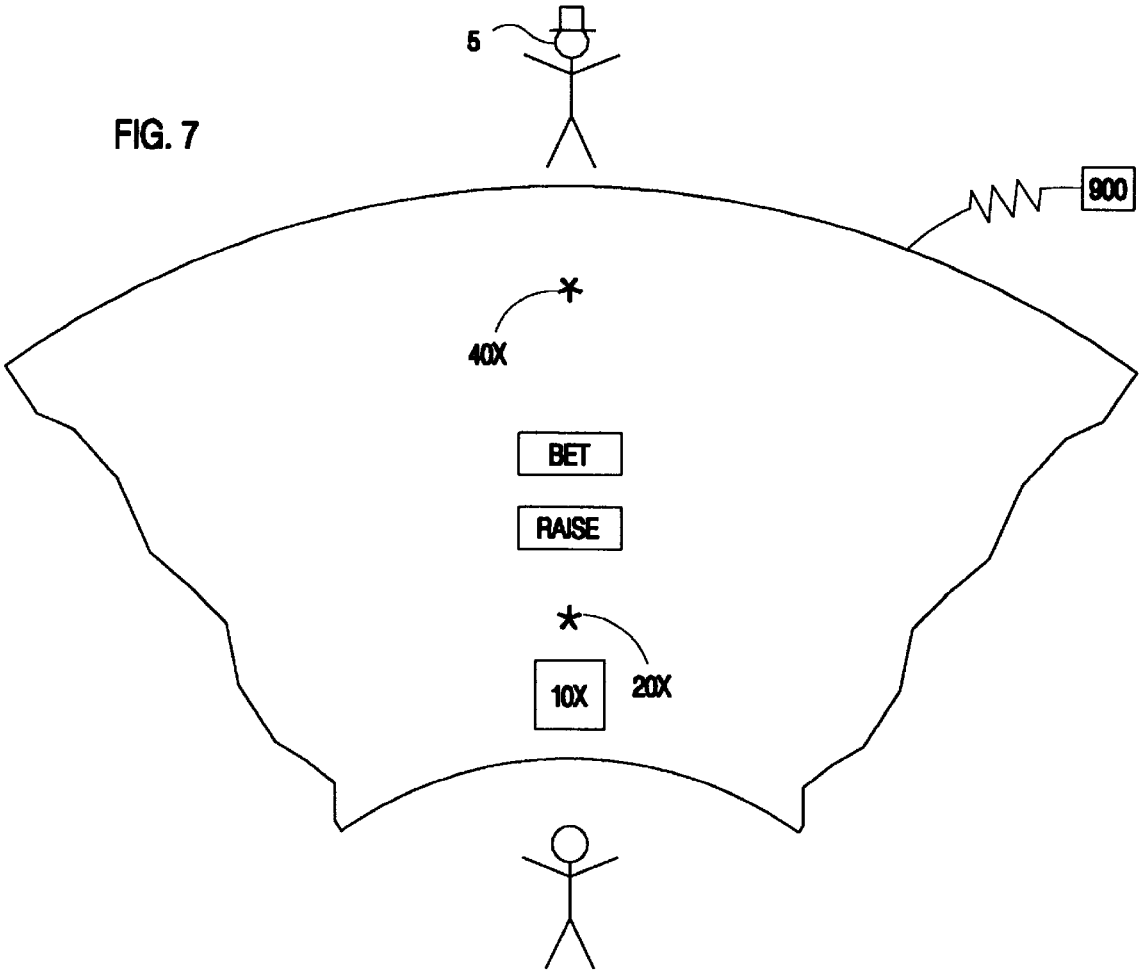
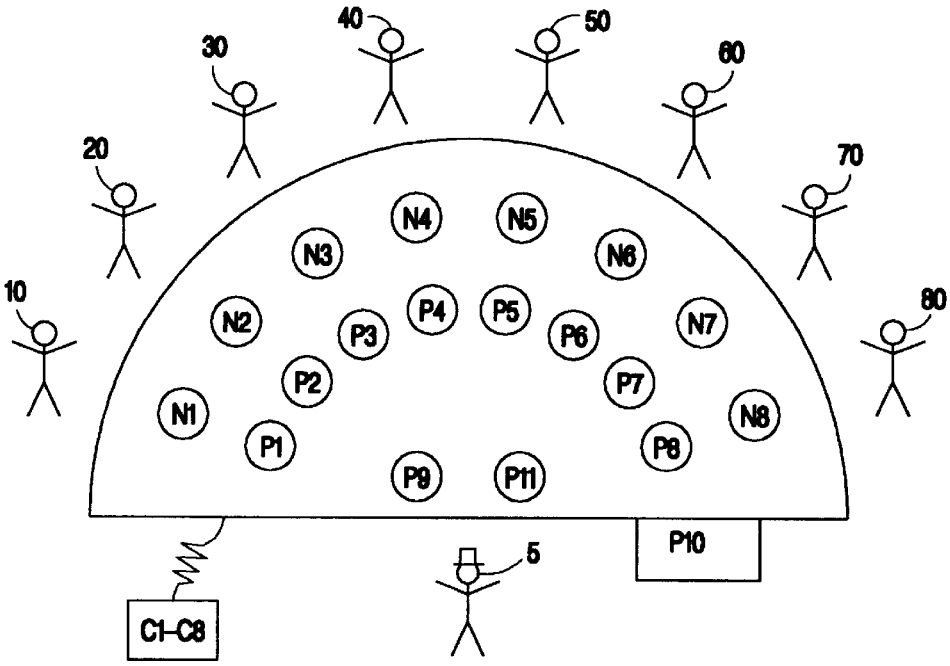
FIG. 9

CASINO TABLE SENSOR ALARMS AND METHOD OF USING

FIELD OF THE INVENTION

This invention relates generally to detection and monitoring systems for casino tables, and more particularly to devices which monitor the players' and dealer's movement of their hands and chips during the play of casino games.

BACKGROUND OF THE INVENTION

Casinos are multi-billion dollar industries. The amount of money that flows through an active casino each hour is staggering, with the odds of winning heavily stacked against the patrons in favor of the casino, or the "house."

The casino industry is a relatively young industry in this country, developed only within the past twenty to fifty years. It is frequently frowned upon by religious, moral and community leaders because casinos have a tendency to attract, at least in their eyes, sinful, wasteful and unprincipled people, not to mention additional corruption introduced from the outside as the result of the influence of underground (mob) forces. Nevertheless the casino industry continues to grow as the general social climate becomes more liberal. The rise of the independent Native American nations has resulted in additional recent growth of the casino industry, particularly where such growth was previously prevented by state and federal governments. Riverboat, marine and other off-shore gambling is also on the rise.

The casino industry, while arguably attracting non-desireables, does provide a considerable monetary benefit to the state and general community in which the casinos reside or operate. Casinos contribute taxes, license fees, and at least a percentage of their operations to benefit the state and the community. This potential for increased revenue makes casinos an attractive and desirable enterprise which usually benefits the community more than it probably harms it. Even churches sponsor casino trips for the revenue it brings.

In addition, casinos probably have other socially redeeming features, not the least of which is the hope it generates in those who otherwise may feel little to be hopeful about. This last is one reason casinos are usually particularly popular with retired citizens who also, of course, have additional time on their hands to attend casinos.

Two things are required in order for a casino to operate effectively. The first, and obvious element, is the monetarily endowed gambler. The chance to "make it big" is enough to attract almost anyone with some money burning in their pocket, other than perhaps the trained statistician and the born pessimist. Of course, there are also those affluent persons who view gambling as a hobby, and wouldn't think twice about dropping a substantial sum of money in one day. There are also career gamblers, whose existence depends on winning enough money to make it to the next day of gambling, some of whom become skilled enough to consistently remain somewhat ahead. Finally, there is the con-artist gambler, who manages to reverse the odds of winning by cheating and defeating the system. Con-artists costs casinos millions of dollars each year in lost revenues, which ultimately results in decreased revenues to the state and community.

The second necessary element for an effective casino operation is an efficient casino management and security system. This responsibility extends from the person in charge of the casino, all the way down to each individual dealer at each separate table. Hundreds of people in each casino are paid a substantial amount of money just to observe the gamblers, in addition to the thousands of dollars spent on electronic surveillance and the personnel who monitor such equipment. Dealers are schooled and trained in techniques which are supposed to be harmonized throughout the industry, focusing on the shuffle, card handling, and player association and relation. The interaction between the dealers and the gamblers is the most scrutinized, since hundreds of dollars can be exchanged in a single hand.

The dealer/player interaction is, for the most part, monitored by electronic surveillance and roving observers. Electronic surveillance usually takes the form of electronic camera globes which blanket the walls and ceilings of the casinos, which appear to serve more of a deterrent purpose than a true constant surveillance function. For the most part, the cameras, or the monitoring personnel for such cameras, only monitor those tables which have been reported as containing observed questionable activity. Therefore, most of the time, any given table goes unmonitored.

There are three potential problem areas which monitoring systems are supposed to alleviate. The first, and most obvious problem area, is the gambler who cheats without the aid of another human being. This person may surreptitiously and illegally increase or decrease his or her stakes during the play of the game, or surreptitiously and illegally move his or her wager from one part of the table to another after the fate of the game has been decided. The second, and not so obvious problem area, is the dealer who cheats without the aid of another human being. The dealer may clear the losing gamblers' chips from a table once the play has ended, and secretly divert a chip or two from the chip bin to his or her own pocket. The third problem area occurs when a dealer and a player act in concert to cheat the casino. This "symbiotic" relationship can be one of the most difficult to detect, since the outward manifestations and communications may not be as clear to a roving observer or hidden camera as would a gambler who physically moves a chip from one table location to another or a dealer who appropriates chips or the like.

The gambler who cheats by moving chips is usually the primary focus of security measures. Experienced cheaters have a way of maneuvering themselves in such a way as to avoid detection by any cameras or roving observers, usually by huddling over their positions with their backs to the cameras and their bodies over the playing area. Cheaters also use the placement of their cocktail drinks upon the casino table as an avenue to move chips. A chip, hidden in the hand used to grasp or pick up a drink from the table, is inconspicuously added to the cheater's betting pile as the drink is being returned to the table. This "taking a sip of a cocktail" hand motion may also be substituted by the facade of "taking a smoke from a cigarette." A chip, hidden in the hand used to grasp a cigarette from an ashtray, is inconspicuously added to the cheater's betting pile as the cigarette is being returned to the ashtray. The cheating gambler is a particular problem, because while their cheating techniques follow certain patterns, each has his or her own variations, and it is basically necessary to obtain clear evidence of cheating before the cheater can be arrested or barred from casino premises.

DISCUSSION OF THE PRIOR ART

Of the three potential problem areas discussed in the previous section, only the second and third problem areas have been competently addressed within the prior art. The second problem area, i.e. the dealer who cheats without the aid of another human being by secretly diverting casino chips into his or her personal possession, has been addressed mostly by using encoded chips and accompanying sensors. Sensors can be placed in the personnel areas which are continually scanning the employees as they pass to and from the personnel areas and the casino floor. These types of sensor systems are also effective to prevent patrons from carrying chips outside the casino perimeters. The third problem area, which deals with players and dealers acting in concert to cheat the casino, has been addressed by creating decks which allow the dealer to ascertain whether or not the hand comprises a blackjack or "21", but at the same time preventing the dealer from ascertaining the value of the face down card. The following patents are representative of some of the detection schemes previously suggested as used for surveillance of gambling operations.

U.S. Pat. No. 4,755,941 issued to L. Bacchi on Jul. 5, 1988, entitled "System for Monitoring the Movement of Money and Chips on a Gaming Table", discloses a monitoring system detection device which tracks the dealer's performance and profit percentage. The device includes detecting and keeping track of casino chips and cash handled by a dealer at a gaming station. No aspect of this apparatus or system focuses on the players or their movements per se. The Bacchi device monitors the amount of money the dealer receives from the players, as well as the relationship between the incoming and outgoing chips in the dealer's bank. The system will alert any roving managerial staff if the dealer's bank is not commensurate with the chip distributions, or if the dealer is operating with a low profitability.

U.S. Pat. No. 5,283,422 issued to L. Storch and E. van Haagen on Feb. 1, 1994 entitled "Information Transfer and Use, Particularly With Respect to Counterfeit Detection", discloses both methods and apparatus for automatically obtaining real-time information relating to the movement of casino chips. This reference discusses the physical coding of casino chips for the utilization of information such as chip counting, chip identification, eliminating counterfeit chip losses, and chip, cash and casino operation management. As in the Bacchi patent, the results of detection of the casino chips is fed to a central computer for monitoring.

U.S. Pat. No. 5,299,803 issued to J. E. Halaby on Jul. 5, 1988, entitled "Apparatus for Using Embedded Chips in a Gaming Table", discloses a gaming table designed to electromechanically change chip arrays on the gaming table. The player changes such arrays by pressing appropriate keys on the side of the table, thus obviating the player actually touching the gaming chips and allowing the chips to be automatically counted. This eliminates incidentally any chance of the player changing the chips without the knowledge of the dealer or at least the knowledge of the "house."

U.S. Pat. No. 5,362,053 issued to A. Miller on Nov. 8, 1994, entitled "Card Reader for Blackjack Table", discloses a device for reading the face-down card of a dealer for the detection of a potential blackjack hand, where such hand is considered an automatic win for the dealer. If the dealer knew that he or she had twenty one, then there would be no need to engage every player at the table, and the next hand could be dealt as soon as possible. The Miller reference provides a time-saving device, where the card reader can use several different means to secretly disclose the identity of the face-down card to the dealer, without providing any player at the table with the means to ascertain this information. The detection means is located in the upper surface of the blackjack table and either detects the card face directly or detects some special identification means on the card.

U.S. Pat. No. 5,406,264 issued to C. Plonsky and T. Riley on Apr. 11, 1995, entitled "Gaming Chip with Magnetic EAS Target", discloses a gaming chip in which is disposed an amorphous magnetic marker material for detection by an electromagnetic article surveillance systems or EAS magnetic system. The primary intent of this reference is to provide a gambling chip which will prevent, or deter, casino employees from stealing or misappropriating casino chips.

U.S. Pat. No. 5,518,249 issued to R. Sines and S. Forte on May 21, 1996, entitled "Cards and Methods for Playing Blackjack", discloses a method for the dealer to ascertain whether or not he or she has a blackjack, or twenty-one, before the play of the hand commences. A specially constructed deck is used in accordance with this invention to complement the dealer's method of playing. The cards are printed in such a way as to alert the dealer as to the existence of a winning hand, and on the other hand, preventing the dealer from actually ascertaining the value of the face down card if the dealer does not have a winning hand. Therefore, the act of the dealer peeking does not jeopardize the subsequent play of the game from both the casino's and the player's standpoint.

The prior art has, therefore, largely directed its attention to the use of state of the art surveillance systems or "eye-in-the-sky" systems, plus the use of roving human observers, plus the monitoring of the movement of casino chips on the gaming table. The prior art largely fails to address the most serious problem facing every casino, namely the gambler who illegally influences his or her betted chips during the play of the game unbeknownst to the dealer or the roving security personnel. A common cheating scenario, in the game of blackjack for example, is the player who increases or decreases his or her ante once the dealer's second card is dealt. Of course, this is accomplished as subtly as possible, and it is usually performed by a player sitting at the totally opposite side of the table from where the dealer's concentration lies.

Traditionally because of cost considerations, casinos only really direct their security efforts to a particular gaming table, or to a particular person, if and when they begin to suspect some nefarious activity is occurring at a particular table. It is not until such suspicion arises, however, that the security issue becomes a matter of heightened concern. As a practical matter, it is nearly impossible to watch every single player at every single table, during every single second of time. Video surveillance can only go so far, and the human element is always present in evaluating the actions of persons at the gaming tables and thus the effectiveness of this type of optical security system. For the most part, the dark globes which blanket the ceilings of most casinos, serve as a deterrent to cheating, since the players never really know who is watching or from where. For the most part, therefore, the casino as a practical cost related matter must depend to a large extent upon the basic honesty of most players, using the security systems available basically to keep the relatively honest gamblers honest in order to avoid the embarrassment of being caught cheating, while occasionally catching regular cheaters and barring them from further access to the gaming tables or premises.

The cautious, deterred player, who one day attempts to cheat and gets away with it, and upon the realization that it is possible to repeat his or her cheating, may well convert from an honest player into one who actively flaunts the inadequacies of the available security system. Casinos are not allowed in many jurisdictions to take immediate action against a known cheater, unless the cheater's actions are recorded three different times, or at least more than once, so that a record can be created to add weight to the casino's reason for acting. Casinos usually either give the cheater a warning, confiscate his or her chips, or banish him or her from the casino altogether. Criminal sanctions usually are not pursued unless the offender has been caught multiple times, or unless the monetary loss to the casino is substantial.

Regardless of what occurs, a tagged or identified cheater can usually walk next door to a neighboring casino and begin his or her cheating routine or scheme all over again. And if there is no other casino nearby, this cheater can go to another venue which provides legalized gambling of this nature, or to a riverboat, or to another country. The expansion of the casino gaming industry progressively increases the number of gaming tables, thereby increasing the opportunities for cheating and incidentally the number of potential cheaters.

There exists a need, therefore, to provide a system or apparatus for detecting cheating in casino games by the detection of unauthorized movement over or in the vicinity of a casino game table.

OBJECTS OF THE INVENTION

It is an object of the present invention, therefore, to provide a device which can be incorporated into a casino gaming table to make the dealer, and/or any casino security official, aware of any player, and at any time, who cheats by manipulating his or her chips during the play of any game.

It is still a further object of the present invention to provide a device which can be used with any existing, conventional gaming table, and does not require the manufacture of an unconventional gaming table top.

It is still a further object of the present invention to provide a device which cannot be visually detected by any person standing adjacent to the gaming table which has the device of the present invention within.

It is still a further object of the present invention to provide a device which will operate with conventional playing cards and conventional gaming chips, and does not require the use of specialized cards or chips.

It is still a further object of the present invention to provide a device which is resistant to the environmental hazards of casinos, and which will not be affected by any potential liquid refreshment spill hazards or the like which may potentially occur at the surface of a gaming table.

It is still a further object of the present invention to provide a device which can sense when a player's major body part, such as a hand, moves into or about a particular area on the gaming table, such as where the betted chips lie., and upon such occurrence, alerts an appropriate individual or system It is still a further object of the present invention to provide a device which, upon sensing a particular player's body part in or about a particular area on the gaming table, will send a signal to an appropriate individual or system alerting such individual or system to such player's movement.

It is still a further object of the present invention to provide a device which will alert an appropriate individual or system when a player cheats beginning with each individual occurrence, and does not first become activated upon the second or third occurrence of cheating by such player.

It is still a further object of the present invention to provide a device which can sense whether or not a dealer is following the standard dealing procedure, which instructs proper hand movement on or over the gaming table, proper hand placement during the dealer/player interaction, and proper hand movement when the dealer finishes the round of play.

Additional objects and advantages of the present invention will become evident from a careful review of the following explanation and description in combination with the appended drawings.

BRIEF DESCRIPTION OF THE INVENTION

The device of the present invention incorporates a system of sensors which are strategically positioned about a casino gaming table, although preferably placed under the surface of a gaming table, which monitor the movement about certain predetermined areas on the table, whether such movement may be initiated by a player or a dealer. The sensors of the system do not follow the movements of dealers or players, but merely monitor certain areas of the table and are triggered, or activated, or change state, if such sensors detect movement, or the presence of an object, in those specific areas. Therefore, the sensors are generally passive in nature, and require some kind of movement or change in position to become active.

In their simplest application, the sensors indicate when either a player or a dealer places his or her hand in an area of the table where it should not be placed during that specific time. Using roulette as an example, the sensor would indicate if a player moves a bet from one area of the board to another without the dealer noticing, and before the dealer begins to pay out. Using blackjack as an example, the sensor would indicate if a player places his or her hand in a position from which chips can be added or subtracted from his or her initial bet after the dealer exposes his or her face up card. Of course, both of these situations are supposed to occur when the dealer "isn't looking," or is otherwise occupied. Usually, this occurs when the dealer is interacting with players at the opposite side of the table from where the cheating player is situated. The sensors may also indicate not when cheating may be occurring, but when certain playing procedures are initiated in order to begin or terminate certain of the surveillance procedures.

The sensors are generally located in three different areas of the gaming table, defined by the dealer's area, the player's area, and the gaming area. The dealer's area is located closest to the dealer, the player's area is located closest to the players, and the gaming area is usually where each player places his or her chips during the betting phase of the game. For example, in blackjack the gaming area would be defined by the little circles on the gaming table where each player stacks his or her chips during the initial ante phase, and any subsequent betting phase, while in roulette the gaming area would be defined by the grid of numbers which indicate each player's chips and their respective wagers.

A control system, depending on the particular casino game, regulates when certain sensors are active, and when certain sensors are inactive, or should be de-activated. Normally, the dealer interaction with each player at a table will help configure the control system. Using roulette as an example, sensors would line the roulette betting grid containing all of the player's bets, and would activate upon the spinning of the roulette wheel. The sensors would remain active until the dealer has finished with all the bets, and then the sensors would deactivate in time to allow all of the players to gather their winnings. If a sneaky player decides to attempt to change the position of a chip on the betting grid in that split second between when the ball drops and when dealer scans the betting grid to acknowledge the winning number, interposition of the player's hand will activate the sensor and notify the proper person or system. In the case of roulette, the sensors could activate when the dealer declares the end of the betting and deactivate when the dealer begins to assess the betting grid to evaluate the winning positions.

The sensors used are preferably capacitative sensors, which have proved simple, economical, sturdy and difficult to change or miscalibrate by the normal mishaps in a casino environment.

It will be recognized that it is possible for the sensors to notify either a person or a system. The sensors can be linked directly to an individual, or to a notification system which can target and/or track the sensor activity present in the casino. A possible notification system can be audible, visible, electrical, or computer-oriented.

For the purposes of the following discussion, the game of blackjack will be used to illustrate the details of such a device. The game of blackjack is merely one of many table-based casino games which can incorporate this device, as illustrated with the game of roulette in the previous discussion. The present inventors do not mean to limit the device of the invention to the game of blackjack, since its implementation can benefit almost any other table-based casino game involving cards or casino chips in addition to blackjack.

BRIEF DESCRIPTION OF THE DRAWINGS

FIG. 5A is a diagrammatic plan view of an imaginary generalized upper surface of a roulette wheel for purposes of illustrating the device and the system of the invention while playing a roulette type casino game.

FIG. 6 is a diagrammatic plan view of an imaginary generalized upper surface of a casino game table for purposes of illustrating the device and the system of the invention while playing a baccarat type casino game.

FIG. 7 is a diagrammatic plan view of an imaginary generalized upper surface of a casino game table for purposes of illustrating the device and the system of the invention while playing an "acey-deucy" type casino game.

FIG. 9 shows the circuit elements of the device and system of the present invention superimposed upon a blackjack type casino table in order to more easily illustrate the entire electronic system of the invention.

DESCRIPTION OF THE PREFERRED EMBODIMENTS

The present inventors, after a thorough study of the difficulties encountered with cheating generally in games played on gaming tables in casinos, have developed a system for detecting the interposition of portions of the body of players' and dealers' over potions of gaming tables where movements pursuant to cheating usually takes place or where movement is made during normal play in order to control the system. The preferred detectors are capacitive type detectors which are fairly cheap, sturdy, difficult to damage or miscalibrate and effective without modification of the chips or the like. Any movement that disturbs the magnetic field produced by the sensor will be detected and may be used to trigger the sensor's recognition system. Consequently, the system will trigger whether movement is made over predetermined portions of a gaming table by the human hand, a casino chip, a dealer's card, or the like as long as the field is broken by some object. Other types of detectors such as inductive sensors, ultrasonic detectors, pyroelectric sensors, and the like could also be used. As indicated, capacitive sensors are preferred. The system has basically three parts namely:

(a) an initiation and deactivation portion which automatically activate the system without the explicit knowledge of the players or the dealers, usually by the interposition of the dealer's hand over a specific portion of the gaming table as part of the game or preliminaries to the game or ending of the game, (b) a system for detection of unauthorized movement over the gaming table in areas where players will usually attempt to move something on the gaming table, such as casino chips or cards on the table, during actual play (this system may include a discrimination routine to determine a certain pattern of activity usually involved in cheating), and (c) a system for alerting security personnel of the unauthorized activity.

The initiation and deactivation system may be broken up into two separate systems for initial activation of the system and for deactivation of the system after play so that harmless activities such as clearing chips or cards from the table will not activate the system.

Figure 1:
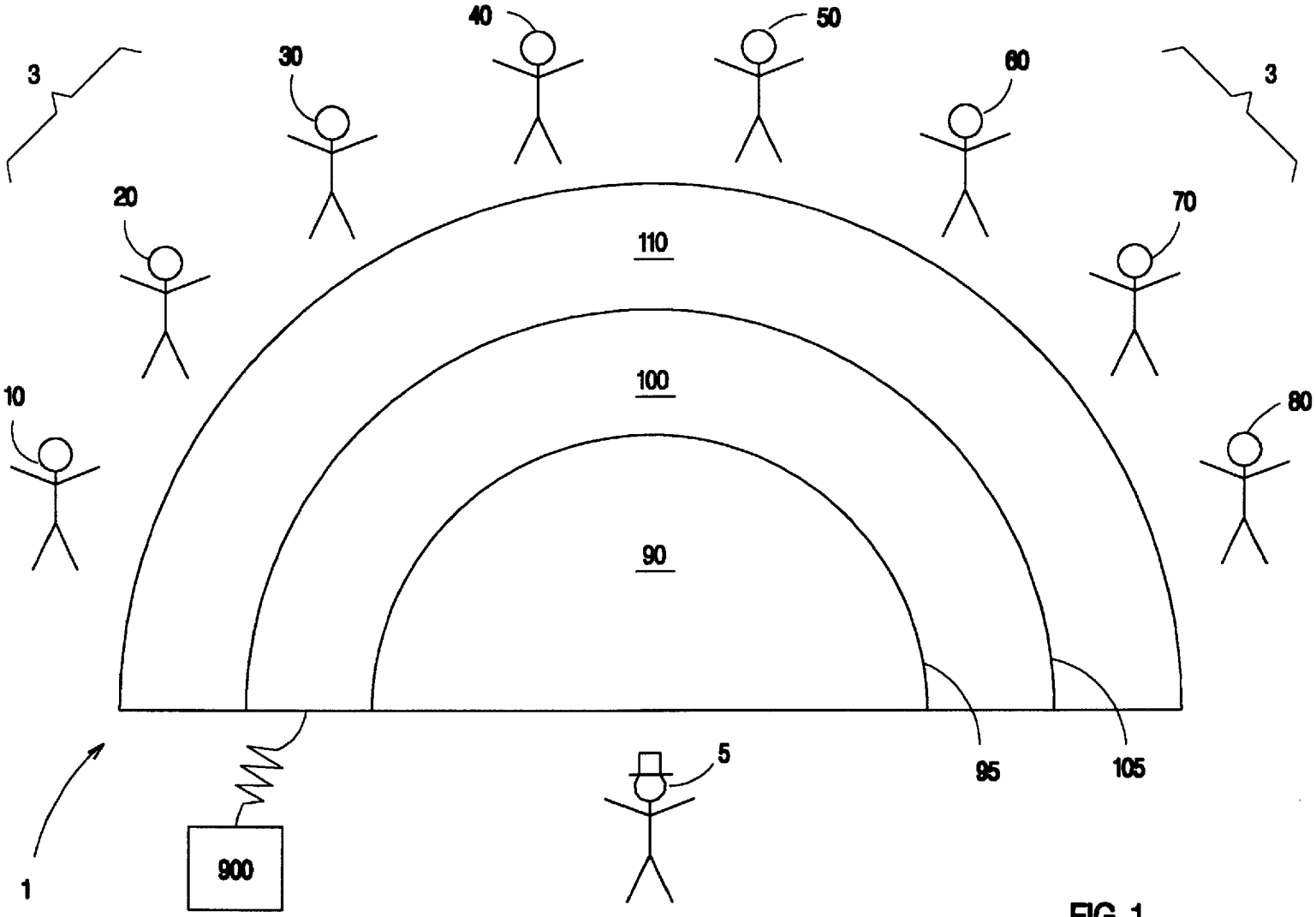
FIG. 1 is a diagrammatic plan view of an imaginary generalized upper surface of a casino game table for purposes of illustrating the playing of a casino game.

FIG. 1, which shows a diagrammatic plan view of a hypothetical generalized casino table for the playing of a casino game, lays the foundation through which more specific casino games will be explored in more detail. In general, there is provided a casino gaming table 1 which is supervised or operated by a representative 5 of the casino, who is usually designated as the "dealer," if the game is based on cards. However, the casino representative 5 may not actually be a "dealer" in the sense of dealing or giving out cards, since he or she could be the person who spins the roulette wheel, or the person who spins the money wheel, or the "pit boss" or the two "side people" in a craps game. On the other side of the gaming table 1 are located the players 3, here specifically referred to as 10, 20, 30, 40, 50, 60, 70 and 80. The casino representative 5 is usually located on one side of the table 1, and is situated directly opposite the players 3. The table is comprised of three general regions, namely the player's area 110, the betting area 100, and the casino representative's area 90, in accordance with the description previously provided. The player's area 110 usually is provided with the player's own betting chips, which are not the same chips which are used to represent the player's wagers during the game. The players' chips, which are used to represent the respective players' wagers, are usually placed in some particular location in the betting area 100. The boundary 105 between the player's area 110 and the betting area 100 is the focus of much of the sensor activity of the present invention, since any activity of the player that crosses this boundary 105 during the play of the game, in order to surreptitiously or illegally influence his or her standing wager, is the particular activity which the device of the present invention is designed to detect. The boundary 95 between the betting area 100 and the casino representative's area 90 is usually not the main focus with respect to the individual players 3, since the players 3 do not usually extend their reach past the betting area 100. The device of the present invention is particularly designed to monitor the boundary 105, therefore, in some manner, so as to place the casino on notice when any player crosses that boundary 105 with the intent or hope of surreptitiously or illegally manipulating his or her wager. In general, therefore, in accordance with the invention, motion detector apparatus will be provided to detect any activity taking place across the boundary 105 as between the player's area 110, upon which the players 3 may place their hands, lean with their elbows, rest their drinks or the like, and the betting area 100, in which gambling chips representing the wagers of the players and the like may be placed. In addition, the dealer's area 90 is usually provided with detectors to activate and deactivate the system at certain predetermined times depending upon what the dealer 5 does in running the game. The monitoring device 900 receives signals from the table 1 when any of the sensors is activated, and provides for communication of the activity on the table to security personnel or a central monitoring system such as a computer or the like. Only signals indicating unauthorized movement in the betting area are usually passed to the security personnel or central security system.

The monitoring system 900 is an integral element of the device of the present invention, and can assume a wide variety of embodiments. The present inventors envision at least three different monitoring variations, depending on the number of tables monitored and the type of technology implemented. For purposes of illustration, assume that there are five tables being monitored at a given time in a given location of the casino. The three different monitoring variations could then be as follows:

(1) An externally visual system which identifies the table number and the player at such table, either in the form of lights or LED signals, that are either visible from the casino floor or from a hidden place. If in the form of lights, one row of five lights may represent the five tables directly above a second row of eight lights representing the eight players at each table. Assuming that in the first row of lights on the visual monitoring device, the third light is lit, while the second light is illuminated in the second row of lights, monitoring personnel will be advised that the second player at the third table has tripped the sensor. Such monitor will then either reset the table or direct his or her attention accordingly. A LED based system may utilize two numbers, one number representing the table while the other number represents the player, in a similar overall code to that used by the light-based monitoring system.

(2) A second possible arrangement might be an audible system, where the monitoring system alerts roving security personnel as to the table and player, such sensor signal being converted directly into an alert response signal received by portable radio or wireless communication apparatus carried by security personnel. Another possible audible variation might utilize a similar code system as used with the lights, where the table representation might, for example, take the form of long audible tones, and the player representation might take the form of short audible beeps. Therefore, if the second player at the third table has tripped his or her sensor, then someone may hear "booop booop booop bip bip" and be alerted to that particular location.

(3) A third possible arrangement involves the use of a central monitoring station, probably computer equipped, which can detect the activity of every table being monitored at once, and respond accordingly, either with signals or through appropriate action. For example, if one table is being tripped three times in one minute, the monitoring station may then direct the camera's eye to that table. If the table keeps having problems, then the monitoring station may boost the security at the table by alerting one or more of the roving security personnel. In other words, the monitoring system may not alert actual human personnel immediately, and may wait until an increased predetermined minimum amount of unauthorized activity is detected.

The monitoring system 900 is not restricted in scope by the detection arrangement or system of the present invention, since the system of the present invention is concerned with detecting movement on or about a casino gaming table and emitting a signal to that effect. How each casino utilizes this signal will determine the scope and effect of the monitoring system 900. The present inventors envision a preferred embodiment for the monitoring system to incorporate a central computer system which keeps records, digests, and disseminates information in accordance with the signal it receives from the casino gaming tables. The monitoring system 900 is represented in an identical manner for each game detection system disclosed in this application. The monitoring system 900 is not meant to be restricted to what has been described, but is meant to accommodate the specifications of both the amount of tables, each casino's technical capabilities, and how each casino wishes to utilize the information that is monitored and detected.

Figure 2:
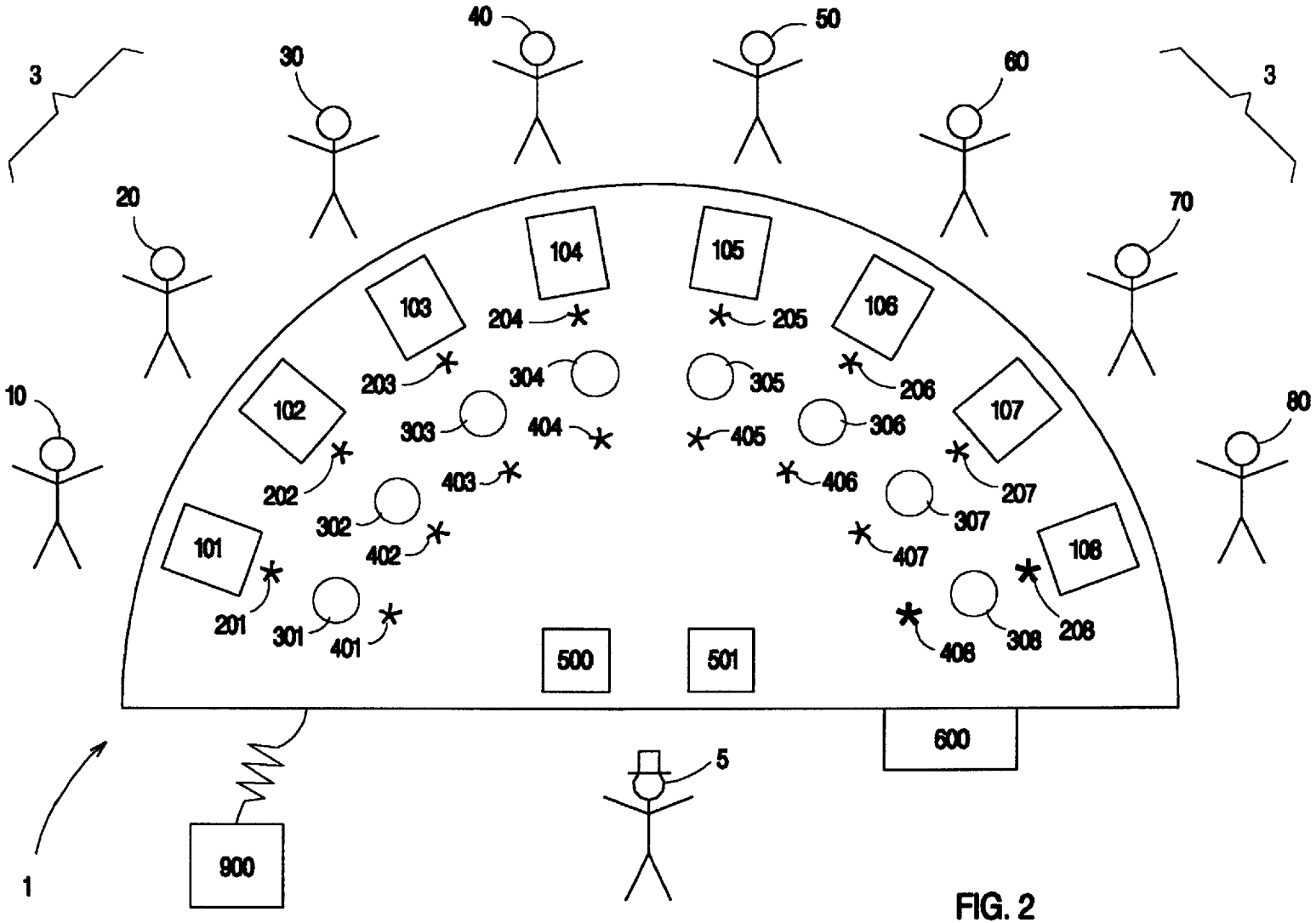
FIG. 2 is a diagrammatic plan view of an imaginary generalized upper surface of a casino game table for purposes of illustrating the device and the system of the invention while playing a blackjack type casino game.

FIG. 2 is a diagrammatic plan view of a blackjack game table and shows an implementation of the device of the present invention in the game of blackjack. The semicircular table 1 has the casino representative 5, here the dealer, facing eight (8) players positioned around the arcuate portion of the table designated 10, 20, 30, 40, 50, 60, 70 and 80, with the first player 10 located to the dealer's immediate left at the corner of the table, while the last player 80, or eighth player, is located directly opposite the first player 10 at the opposite corner of the table. While conventional seating for a blackjack table is seven players, the present inventors are illustrating the operation of the device of the present invention with eight players to demonstrate its versatility and that it is not constrained by conventional dimensions. It will be recognized that the number of players around a table that is implementing the device of the present invention is limited only by the size of the physical table and not necessarily by the capacity of the dealer's attention. It is customary for the dealer 5 to approach or address the players 3 in a clockwise fashion around the table, hence the dealer 5 starts with player 10 and finishes with player 80. The device or system of the present invention will operate regardless of the number of players sitting at the table, however, for purposes of illustration, it will be assumed that such table 1 contains eight (8) players who are actively participating at all times. The device of the present invention will actually work with as low as one player, or as many as "n" players, where "n" is some definitive number.

Since this table 1 depicts a conventional blackjack table, each player has a designated area for their cards, and each player has a designated area for their wagers. The card locations are designated in FIG. 2 as 101, 102, 103, 104, 105, 106, 107 and 108, for each of the eight players, while the wager locations are similarly designated 301, 302, 303, 304, 305, 306, 307 and 308. The wager locations are usually comprised of hollow circles in the table surfaces, since hollow circles form the most appropriate boundaries for circular casino chips, although the shape of the circles has no effect on the operation of the device of the present invention. The dealer's card locations are defined by the dealer's first card location 500, which can either represent the face-up or face-down card, and the dealer's second card location 501, which can also represent either the face-up or face-down card. The first card dealt by the dealer to himself or herself is usually the face-up card, and the second card dealt by the dealer to himself or herself is usually the face-down card.

FIG. 2 also depicts two other locations correlated with each player, for operation of the device of the present invention, and an additional location of interest for the dealer. The locations designated 201, 202, 203, 204, 205, 206, 207 and 208 indicate the normal locations of player sensors which are strategically located between the card locations 101, 102, 103, 104, 105, 106, 107 and 108, and the wager locations 301, 302, 303, 304, 305, 306, 307 and 308. In addition, the locations designated 401, 402, 403, 404, 405, 406, 407 and 408 indicate the normal locations of dealer hand sensors which are strategically located between the dealer 5 and the wager locations 301, 302, 303, 304, 305, 306, 307 and 308. Both sets of sensors, which form an integral part of the device of the invention, are physically located out of sight of both the players 3 and the dealer 5 or any other observers. The most preferable location would be underneath the surface of a conventional casino table, although the sensors could also operate from above the table, where the sensor's focus would be in the identical locations as designated 201, 202, 203, 204, 205, 206, 207 and 208, and 401, 402, 403, 404, 405, 406, 407 and 408. A sensor location of particular importance to the dealer is designated 600, which represents the dealer discharge location. Sensor 600 is activated when the dealer clears the table of all of the cards, ends the round of play and deactivates the table.

The sensors indicate movement about the regional area of their location dependent upon the sensitivity of the sensors. The location of the player sensors are strategically arranged about the wager locations, because a player must bring his or her hands into or invade the wager locations in order to manipulate the wager which he or she has made. In other words, if a player wishes to increase or decrease his or her wager in the hopes of not alerting the dealer, such player must enter the area defined by the wager locations with a part of his or her body in order to accomplish this. Since the wager locations are the only places on the casino table where each player's current wager is represented, each player must either place his or her hand above or about the wager location in order to manipulate his or her bet. If the detector of the invention is activated at such time, the movement will be detected and brought to the attention of anyone monitoring the system 900.

Figure 2A:
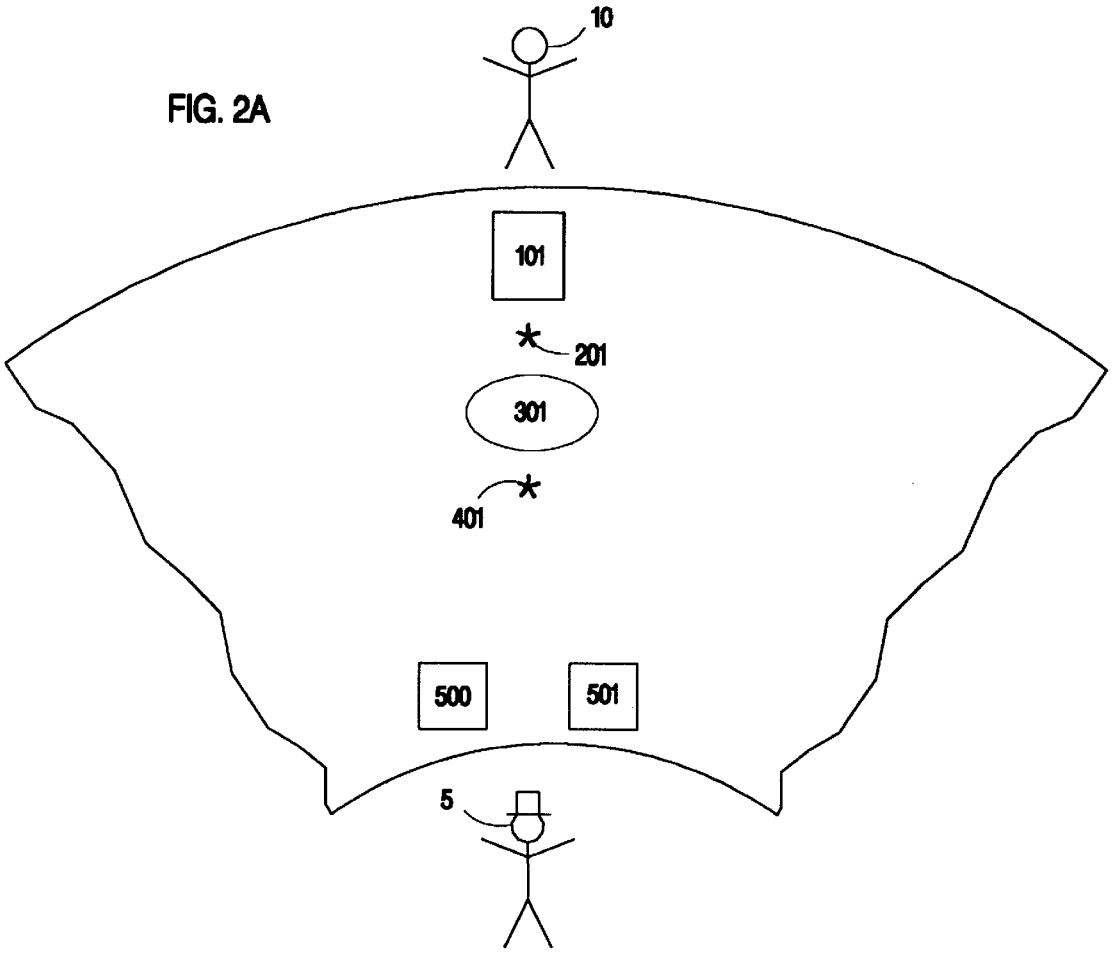
FIG. 2A is a diagrammatic plan view of a section of a blackjack game table showing the sensor arrangement between the dealer and a single player.

FIG. 2A illustrates a sectional view of the sensor arrangements between a single player, here designated 10 and the dealer 5. A typical operational mode of the system, which will be more fully described later, occurs when the dealer 5 has completed dealing the initial cards to every player at the table, and then reveals his or her first card to be placed in location 500. The act of placing a card on the face-up location 500 ending the official deal is detected by the sensor at that location and activates all of the player sensors 201, 202, 203, 204, 205, 206, 207 and 208. If a player wishes to illegally increase or decrease his or her wager after seeing the dealer's face-up card, he or she would have to physically invade the wager location area, and as a consequence, trip the sensor which protects such area, and would thereby send a signal to the appropriate person or system. If no player activates their respective sensor, i.e. if no player decides to cheat, then the dealer starts to progress around the table to elicit each player's response. The act of the dealer placing his or her hand on the table and pointing to a player triggers the dealer's hand sensor, here shown as 401, and this deactivates the sensor of the player who is being acknowledged by the dealer, while the remaining players' sensors remain activated. The triggering of the dealer's hand sensor in front of that respective player indicates that the dealer is focused on that particular player, and therefore there is no need for that player's sensor to remain activated, since the dealer will take note of an illegal activity of the player, who is unlikely to take an illicit action in any event. Deactivating that particular player's sensor also allows that player to legally increase his or her wager in relation to any additional cards requested by the player, such as with a "double-down" or a "split" bet, where both bets require the player to increase his or her wager in order to receive an additional card. The remaining players' sensors remain activated because there is an added incentive to cheat while the dealer is being distracted with another player at the opposite end or any other part of the table. When the dealer finishes with that particular player, he or she points at the next player and by placing his or her hand within the range of the next dealer hand sensor 402, which reacts by sending a signal to the system deactivating the next player's sensor and reactivating the previous player's sensor. As the dealer progresses around the table, the act of the dealer pointing to each player and eliciting a response from each player deactivates such player's sensor and concurrently activates or keeps activated all the other players' sensors.

Figure 3:
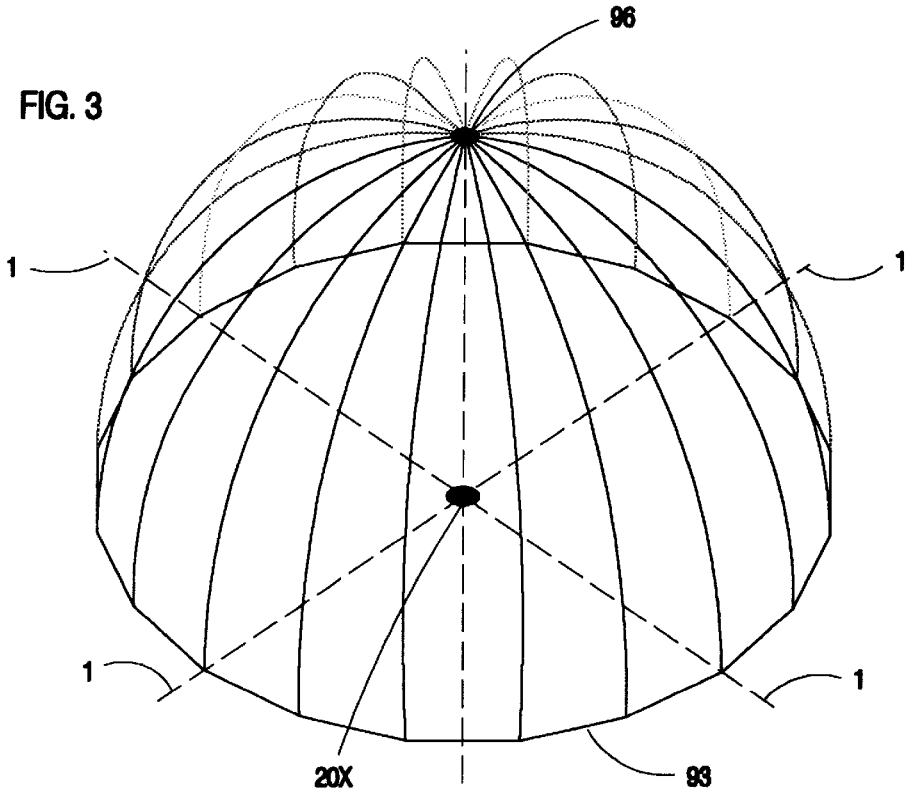
FIG. 3 is a diagrammatic view of a force field of a sensor upon a casino table for the detection of movement on such table.

FIG. 3 illustrates a typical sensor range if the actual sensor were located underneath the surface of a table 1. If the middle of the sensor was designated 20*x* as shown in FIG. 3, where the designation 20*x* represents the respective sensor more fully defined as sensors 201, 202, 203, 204, 205, 206, 207 and 208, then the sensitivity and reach of the sensor could be defined by a semi-circular, spherical region, which would extend a radial distance 93 along the table 1, and similarly a radial distance 96 above the table 1. The sensitivity of each sensor is directly related to the radial spherical region which defines the sensor's reach. The greater the sensitivity, the greater is the radial reach, and vice versa.

Figure 3A:
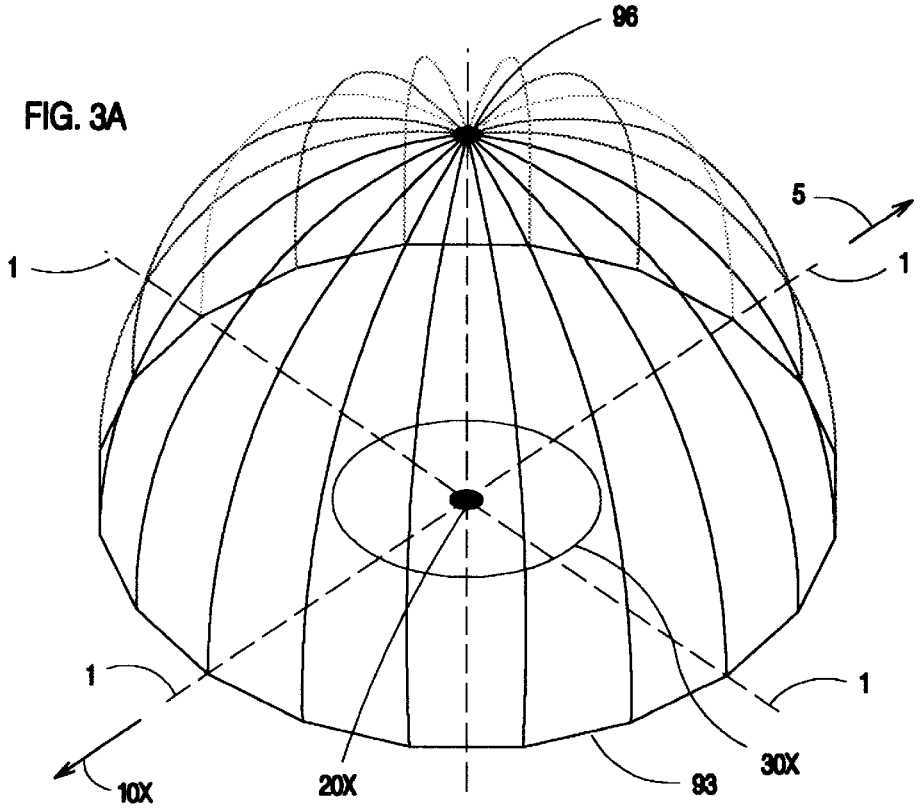
FIG. 3A is a diagrammatic view of a force field of a sensor upon a casino table where the sensor is directly underneath the location to be monitored.

FIG. 3A illustrates the sensor's range in relation to the wager location 30*x*, where 30*x* represents each player's respective wager location fully defined as wager locations 301, 302, 303, 304, 305, 306, 307 and 308, and in relation to the player card location 10*x*, where 10*x* represents each player's respective card location fully defined as card locations 101, 102, 103, 104, 105, 106, 107 and 108, and in relation to the dealer 5. It should be apparent that when the sensor 20*x* is located concentrically beneath the wager location 30*x*, the sensitivity will be felt around the entire wager location 30*x*. This means that the effectiveness of the sensor 20*x* will extend to areas where the players are not likely to reach, i.e. the part of the sensor region closest to the dealer. A player must also come very close to the wager location and sensitivity boundary in order to trigger the sensor.

Figure 3B:
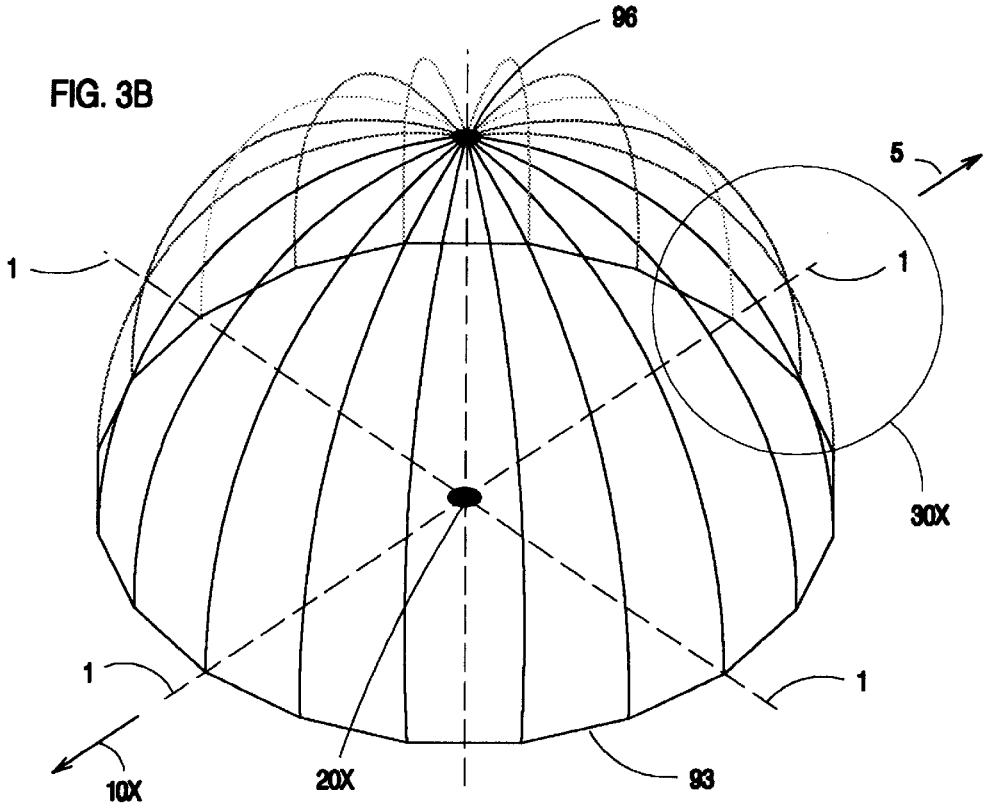
FIG. 3B is a diagrammatic view of a force field of a sensor upon a casino table where the sensor is directly before the location to be monitored.

FIG. 3B illustrates the preferred player sensor location 20*x* which would be, from the player's perspective, between the player's card location 10*x* and the player's wager location 30*x*. With the player's sensor location 20*x* directly before the player's wager location 30*x*, a player would trigger the sensor upon merely approaching the wager location 30*x*, which would occur at a much earlier time than as depicted in FIG. 3A, where the player must almost be on top of the wager location 30*x* in order to trigger the sensor.

Figure 4:
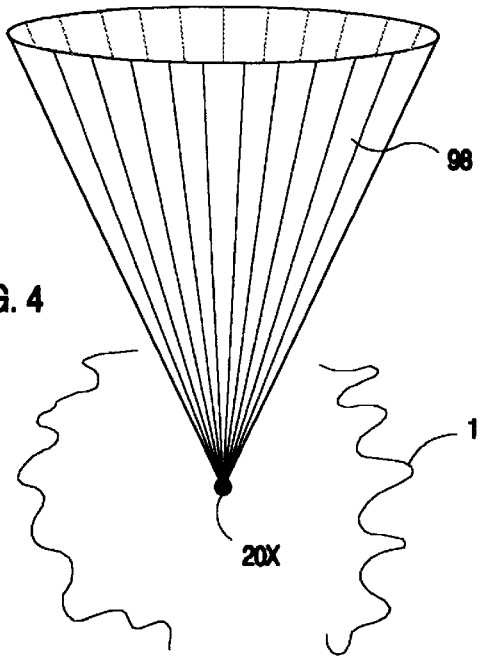
FIG. 4 is a diagrammatic view of a conical force field of a sensor upon a casino table where the sensor is directly underneath the location to be monitored.

FIG. 4 illustrates a cone shaped field 98, as opposed to the spherical fields of FIGS. 3 through 3B. The field shape is determined by the type of sensor, and the intensity and dimensions of the field are also determined by the type of sensor and the amount of power supplied to the sensor. The present inventors realize that the implementation of the system of the device of the present invention requires a type of sensor which monitors movement about a certain location of the table.

Figure 4A:
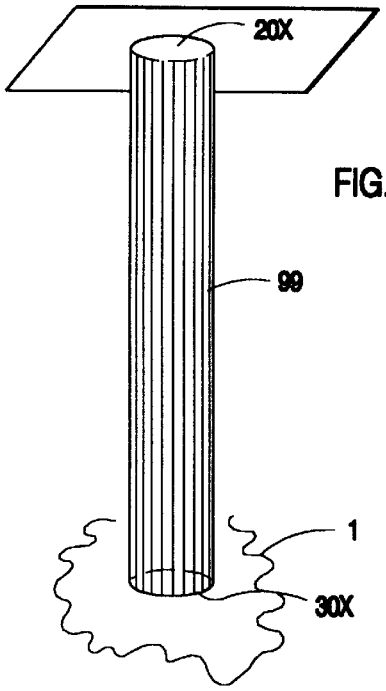
FIG. 4A is a diagrammatic view of a cylindrical force field of a sensor upon a casino table where the sensor is directly above the location to be monitored.

The player sensors could, therefore, resemble not only subsurface emanating fields, but also fields which emanate from other parts of the casino. The player locations could also, therefore, be monitored from above the table (FIG. 4A) via a reflective-type or infra-red arrangement from the ceiling which establishes a cylindrical perimeter field 99 between the table and the sensor. Any break in the sensor field would trigger the sensor. The dealer sensors, and especially the dealer card sensors, should remain subsurface since the dealer is constantly passing directly over his or her sensors to interact with the players. The intensity of the dealer's sensors can vary so the field only extends one inch (or even one card width) above the surface of the table, and this is helpful since the dealer card sensors would otherwise be triggered every time the dealer passes over his or her cards on his or her way to addressing each player.

The following tables illustrate some of the control relationships between the dealer's action and the player's sensors. The rows within the tables designate the player's sensors, while the columns within the tables designate the dealer's sensors. The column designations indicate an action by the dealer, such as the activation of sensor 510 or any of the dealer hand sensors 401 through 408. An "X" indicates that a particular player sensor is inactive, while an "." indicates that a particular sensor is activated. Upon the action by the dealer with respect to one of the dealer's sensors designated in the column headings, the players' sensors designated in the row headings will activate or deactivate accordingly.

For example, as shown in Table 1, at the beginning of the game, all of the players' sensors are deactivated, since there is no reason to monitor any movement until the initial deal is finished. The sensors, in which "X" indicates deactivation of the listed sensor, would resemble the following:

TABLE 1

| | No Dealer Action Taken |
|---|---|
| 201 | X |
| 202 | X |
| 203 | X |
| 204 | X |
| 205 | X |
| 206 | X |
| 207 | X |
| 208 | X |

However, when the dealer finishes dealing all the players' initial cards, and places his face-up card on location and sensor 500, as shown in Table 2, the sensor at location 500 will be triggered and all of the players' sensors will activate as shown below with a dot representing activation of the listed sensor:

TABLE 2

| | 500 |
|---|---|
| 201 | . |
| 202 | . |
| 203 | . |
| 204 | . |
| 205 | . |
| 206 | . |
| 207 | . |
| 208 | . |

All of the players' sensors activate upon the revelation of the dealer's face-up card in order to counter the increased incentive to cheat when the first comparison is made between the player's hand and the dealer's potential hand. The dealer then finishes distributing the final cards to each player and places his or her second card face down on sensor location 501.

As the dealer initiates the interaction with the players, usually by pointing at the player involved, to elicit a response of "hit", "stay", or another appropriate wagering action by the player, the dealer places his or her hand on or close to the respective dealer hand sensor, which triggers the appropriate player hand sensors as follows. The first variable grid, shown in Table 3, illustrates a typical control pattern in which the only player sensor which is deactivated when the dealer acknowledges a player would be the player directly elicited by the dealer:

TABLE 3

| | 401 | 402 | 403 | 404 | 405 | 406 | 407 | 408 |
|---|---|---|---|---|---|---|---|---|
| 201 | X | . | . | . | . | . | . | . |
| 202 | . | X | . | . | . | . | . | . |
| 203 | . | . | X | . | . | . | . | . |
| 204 | . | . | . | X | . | . | . | . |
| 205 | . | . | . | . | X | . | . | . |
| 206 | . | . | . | . | . | X | . | . |
| 207 | . | . | . | . | . | . | X | . |
| 208 | . | . | . | . | . | . | . | X |

The second variable grid shown in Table 4 illustrates a penumbra control effect, where the sensor of the player who is being elicited is deactivated, along with the players on either side of such elicited player. The dealer will presumably have an appropriate view of the player directly in front of him or her, including a peripheral view of the players directly adjacent such player. Consequently, it is fairly safe for the sensors of more than the player immediately addressed by the dealer.

TABLE 4

| | 401 | 402 | 403 | 404 | 405 | 406 | 407 | 408 |
|---|---|---|---|---|---|---|---|---|
| 201 | X | X | . | . | . | . | . | . |
| 202 | X | X | X | . | . | . | . | . |
| 203 | . | X | X | X | . | . | . | . |
| 204 | . | . | X | X | X | . | . | . |
| 205 | . | . | . | X | X | X | . | . |
| 206 | . | . | . | . | X | X | X | . |
| 207 | . | . | . | . | . | X | X | X |
| 208 | . | . | . | . | . | . | X | X |

The fifth table illustrates an anticipatory peripheral control system, where the dealer hand sensor triggers the directly elicited player, along with the player directly following such elicited player.

TABLE 5

| | 401 | 402 | 403 | 404 | 405 | 406 | 407 | 408 |
|---|---|---|---|---|---|---|---|---|
| 201 | X | . | . | . | . | . | . | . |
| 202 | X | X | . | . | . | . | . | . |
| 203 | . | X | X | . | . | . | . | . |
| 204 | . | . | X | X | . | . | . | . |
| 205 | . | . | . | X | X | . | . | . |
| 206 | . | . | . | . | X | X | . | . |
| 207 | . | . | . | . | . | X | X | . |
| 208 | . | . | . | . | . | . | X | X |

The sixth table illustrates a trailing peripheral control system, where the dealer hand sensor triggers the directly elicited player, along with the player directly behind such elicited player.

TABLE 6

| | 401 | 402 | 403 | 404 | 405 | 406 | 407 | 408 |
|---|---|---|---|---|---|---|---|---|
| 201 | X | X | . | . | . | . | . | . |
| 202 | . | X | X | . | . | . | . | . |
| 203 | . | . | X | X | . | . | . | . |
| 204 | . | . | . | X | X | . | . | . |
| 205 | . | . | . | . | X | X | . | . |
| 206 | . | . | . | . | . | X | X | . |
| 207 | . | . | . | . | . | . | X | X |
| 208 | . | . | . | . | . | . | . | X |

The above mentioned control scheme is best suited for a sensor system which utilizes a separate sensor for each individual player. However, it should be realized that due to the spread of the detection area of the detectors, an operative system can be designed which uses fewer than one detector for each player, the one to one relationship being only preferable.

The seventh table illustrates a control theory, described in greater detail in connection with FIG. 8, which contains three distinct groupings of players, namely the first three players, the second three players, and the last two players. Each grouping of players are activated and deactivated in turn, and this occurs when the dealer addresses any one of the players within the group.

TABLE 7

| | 401 | 402 | 403 | 404 | 405 | 406 | 407 | 408 |
|---|---|---|---|---|---|---|---|---|
| 201 | X | X | X | . | . | . | . | . |
| 202 | X | X | X | . | . | . | . | . |
| 203 | X | X | X | . | . | . | . | . |

TABLE 7-continued

| | 401 | 402 | 403 | 404 | 405 | 406 | 407 | 408 |
|---|---|---|---|---|---|---|---|---|
| 204 | . | . | . | X | X | X | . | . |
| 205 | . | . | . | X | X | X | . | . |
| 206 | . | . | . | X | X | X | . | . |
| 207 | . | . | . | . | . | . | X | X |
| 208 | . | . | . | . | . | . | X | X |

After the dealer has finished addressing each player, he or she reveals his face-down card at location 501 and plays out his hand until he or she either "busts", i.e. total point value of the dealer's hand goes over 21, or has to "stay" (dealer must hold once his or her hand totals 17 or over). At this point in time, the entire table is activated, i.e. each player sensor is activated, as illustrated in Table 8.

TABLE 8

| | 501 |
|---|---|
| 201 | . |
| 202 | . |
| 203 | . |
| 204 | . |
| 205 | . |
| 206 | . |
| 207 | . |
| 208 | . |

When the dealer's hand is determined, the dealer must either pay the winning players or collect from the losing players. The conventional way the dealer addresses each player during the payout and collection process is in reverse order to that of the normal betting and playing stage, i.e. starting with the last player at the table and ending with the first player at the table. As the dealer pays or collects from each player, that player's sensor becomes deactivated, and remains deactivated until the game is reset. If the control theory for the sensors during the play of the game resembled that of Table 3, i.e. the addressing of each player deactivates only that addressed player's sensor, then the control theory for the sensors during the payout/collection should be as illustrated in Table 9.

TABLE 9

| | 408 | 407 | 406 | 405 | 404 | 403 | 402 | 401 |
|---|---|---|---|---|---|---|---|---|
| 208 | X | X | X | X | X | X | X | X |
| 207 | . | X | X | X | X | X | X | X |
| 206 | . | . | X | X | X | X | X | X |
| 205 | . | . | . | X | X | X | X | X |
| 204 | . | . | . | . | X | X | X | X |
| 203 | . | . | . | . | . | X | X | X |
| 202 | . | . | . | . | . | . | X | X |
| 201 | . | . | . | . | . | . | . | X |

As the dealer dispenses with each player, such player's sensor deactivates, and joins the other deactivated players' sensors which have already been deactivated by the dealer. During the payout/collection stage, therefore, the only player sensors which remain active are representative of the players which have yet to be addressed by the dealer, i.e. which have yet to receive their winnings or relinquish their losses.

After the dealer pays or collects from each player at the table, he or she will gather up all cards on the table, including the dealer's own cards, and place them in the discard rack. When the dealer places all of the discarded cards in the discard rack, the dealer will trigger, or cross over, the dealer discharge sensor at location 600. The activation of the dealer discharge sensor will deactivate and reset the entire table, and therefore the player sensors will resemble that of Table 10.

TABLE 10

| | 600 |
|---|---|
| 201 | X |
| 202 | X |
| 203 | X |
| 204 | X |
| 205 | X |
| 206 | X |
| 207 | X |
| 208 | X |

Once the dealer discharge sensor 600 is activated or triggered, the player sensors will remain off, or nonactive, until a new hand is dealt and the dealer deals his or her first card and activates the sensor at location 500.

Figure 5:
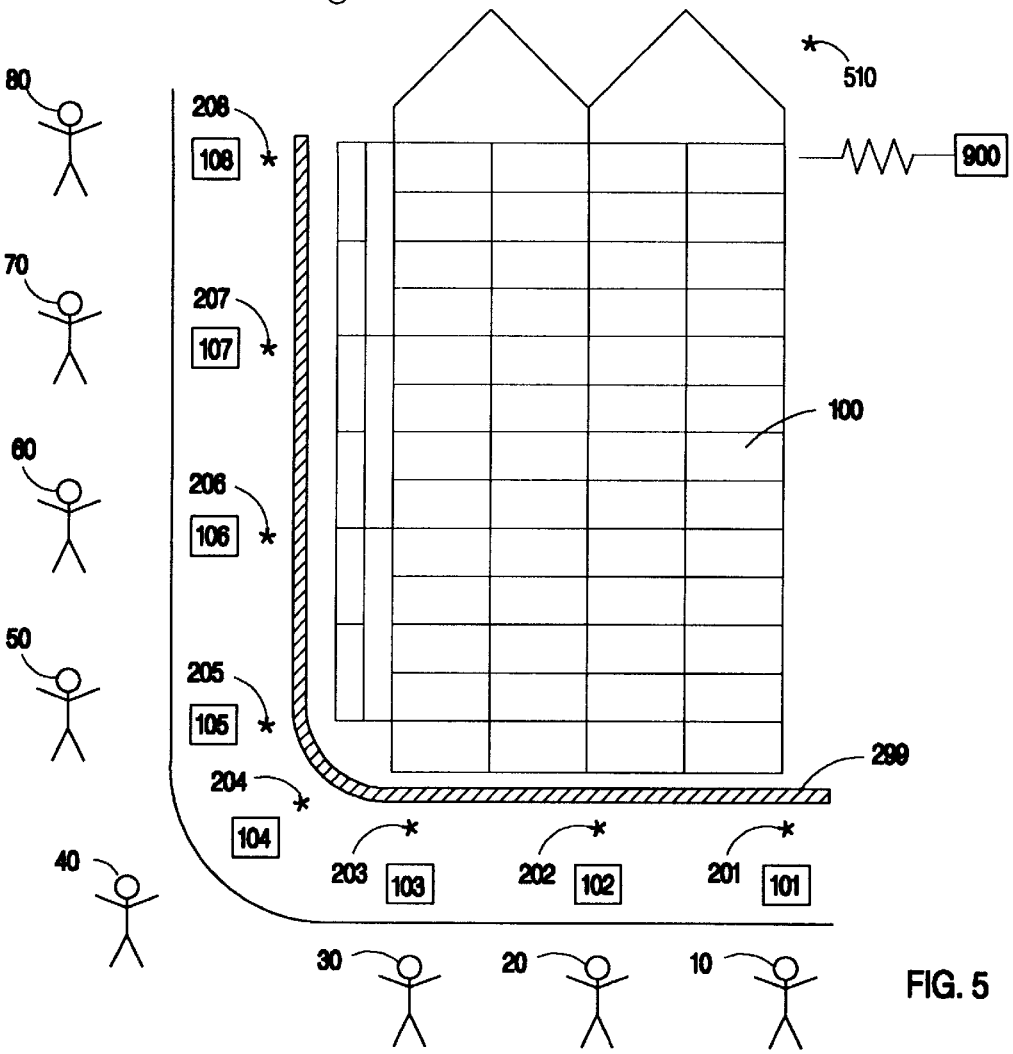
FIG. 5 is a diagrammatic plan view of an imaginary generalized upper surface of a casino game table for purposes of illustrating the device and the system of the invention while playing a roulette type casino game.

FIG. 5 illustrates an embodiment of the device of the present invention adapted to be used on a roulette gaming table. The present inventors have found that the sensor systems can effectively operate with almost any imaginable casino gaming table, with the possible exception of "craps" where it would most likely be unnecessary due to the nature of the game environment. A roulette table is, for the most part, identical in player layout to any other casino gaming table, where a number of players surround the table and wager in an area in front of them while maintaining their own chips by the edge of the table. With reference to the generalized gaming table shown in FIG. 1 and in coordination with and supplementing the earlier discussion of such figure, the roulette board of FIG. 5 can be considered the actual gaming area 100, with the outer boundary of the roulette board identical to the boundary 95 between the players and the gaming area shown and discussed in FIG. 1. The gaming area in roulette is not broken up into eight different player locations like it would be in blackjack, but consists of an entire area of the gaming table within which each player may interact.

In FIG. 5, the player sensors 20*x* can assume a variety of different embodiments, depending on the type of security one wants to achieve. As with the game of blackjack, each player sensor location 20*x* can be directly in front of each player location 10*x*, which would achieve a secure area directly in front of each player. However, since the game of roulette is structured differently, and since each player does not necessarily interact with the area of the table directly in front of him or her, a more practical arrangement would be to effectively "line" the outside boundary of the roulette gaming area 100 with multiple sensors or even a strip sensor 299. While the "end" would be the same, the "means" to such end would be slightly different. A strip sensor 299 would effectively leave no area unsecured.

The game of roulette by its very nature requires the incorporation of a slightly different control theory, since the player/casino representative interaction is not as direct or one-to-one. Roulette only really involves one move on the part of each player, the initial wager. Each player at the table places his or her particular colored chip(s) on a particular location(s) on the roulette board. Afterwards, the casino representative will start the roulette wheel spinning and project the ball around the outer perimeter of the roulette wheel in the opposite angular direction that the wheel is currently spinning. Depending on the casino, all wagering will cease either once the ball is in motion, or alternatively several seconds before the ball lands in a numbered spot. The decision as to when the wagering will cease will govern the decision as to when to introduce the device of the present invention to the play sequence or activate the security monitoring mode of the invention.

When the wagering ceases, the sensors 20*x* or 299 should be activated. These sensors may be activated either manually or automatically. FIG. 5A depicts a top view of a typical roulette wheel 700, which is comprised of the outer perimeter track 710 upon which the ball travels when initially spun about the wheel 700, a slide 720 upon which the ball travels when it starts to make its descent upon losing momentum from the track 710, and the slotted wheel 730 in which the ball will eventually come to rest on a particular colored number. The activation of the sensors 20*x* or 299 can be done externally by action of the dealer, or automatically through the coordinated action of the spinning wheel and the travelling ball. If the casino wanted to secure the table upon the initial launch of the ball, a sensor 715 would be placed on the outer perimeter track 710 which would be triggered after one revolution of the ball.

If the casino wanted to activate the table after the ball starts to make its descent, a sensor 725 could be placed on the slide 720 which would be triggered after at least one revolution on the slide. In order for sensor 725 to fail to operate effectively, the ball would have to vertically drop from the outer perimeter track 710 to the slotted wheel itself 730. This problem could be alleviated by lining the slide 720 with a series of sensors around an inner circumference which defines a perimeter section of the slide 720, or possibly by incorporating a singular ring-shaped sensor mechanism which would operate in the same fashion. Sensor 725 could be eliminated using the track sensor 715 in combination with a statistically determined control theory. A study could be made which could determine the average number of times a ball would revolve about the outer perimeter track 710 before leaving the track 710, and this could be done using sensor 715 in an iterative fashion. The sensor signals could be counted and averaged, and this average number of signals can be used to determine when the table should be activated. For example, assume that an average ball revolves ten (10) times around the track 710 before it starts to make its descent toward the wheel. After about the seventh or eighth revolution, i.e. after about the seventh or eighth sensor signal, the table sensors would activate. Of course, there would have to be some kind of coordination with the casino representative who is launching the ball and the time at which the table would be activated, for if not, then the table would activate while the customers continue to place their bets and before the dealer terminates the wagering.

A final possibility for the casino would be to activate the table when the ball hits, or is about to hit, the actual wheel 730, in which case a sensor 735 would be placed in such a desired location. Sensor 735 could be located directly beneath the wheel, or directly before the wheel, or even located physically within and under each number on the wheel. The preferred location of sensor 735 would be directly before the wheel, since the movement of the actual wheel, before the movement of the ball, would most likely prematurely trigger the sensor 735.

FIG. 6 is a diagrammatic plan view of a broken away section of a baccarat or mini-baccarat table, showing the interaction between a player and the table. Baccarat and mini-baccarat differ in the number of players and who deals the cards. In mini-baccarat, the dealer handles all of the cards, which differs in some respects from Baccarat, where the dealer may supervise the deal of the cards by one or more players at the table. As with the game of blackjack, the gaming table contains three locations of interest. The wager locations in mini-baccarat are indicated by the spaces named "Tie", "Banker", and "Player", while the player sensors 20*x* separate the wager locations from the player locations 10*x*. The dealer location sensors 40*x* serve the same purpose in mini-baccarat as they did with the blackjack embodiment. The interaction between the players and the dealer in either mini-baccarat or baccarat is similar to that in blackjack, where the dealer progresses around the table and deals with each individual player before moving on to the next. The control theory is therefore basically the same as with blackjack, i.e. the dealer will motion toward the player he or she is interacting with which may deactivate that player position and allow the player to take some authorized action related to playing of the game, while the detectors associated with the remaining players to whom the dealer's attention is not directed remain activated to prevent unauthorized actions by such players.

FIG. 7 is an illustration of the device of the present invention applied to the casino game of "Acey-Deucy" (or sometimes known as "Red Dog."). As with FIG. 6, only one player is highlighted to illustrate the table considerations which make Acey-Deucy different from Blackjack. In Acey-Deucy, the dealer turns over and separates two cards for all the players to view. Each player may then wager a certain amount, up to their original ante, as to whether the value of the dealer's next card will be in between the values of the first two cards initially revealed. For example, if the dealer initially turns over a two and a king, there is a very good chance that the next card will be in between a two and a king, for example, an eight. If the dealer's third card was an ace, then the dealer would win and each player would lose.

FIG. 7 illustrates the same player/dealer locations as seen in blackjack and mini-baccarat, where the player sensor 20*x* separates the player location 10*x* from the wagering location, here shown as a "Bet" location and a "Raise" location. The dealer position sensor 40*x* determines the active player and the location of the dealer around the table.

Acey-Deucy has the possibility of obtaining two "tie" bets, where neither the dealer or the player wins. This occurs when either the first and second cards revealed by the dealer are consecutive in value ("consecutive"), or are of the same value ("pair"), in which case the chances of the third card revealed by the dealer being in between the first and second cards in value is nonexistent. When the first two cards are of the same value, or when a "pair" is showing, the third card is drawn, and if it makes a "three of a kind", then the player automatically wins eleven (11) times the original bet. If the card does not make "three of a kind", then a tie results and there is no winner and no loser.

In Acey Deucy, the incentive to cheat is the greatest when the value spread between the cards is great, or when a "pair" is drawn by the dealer. When the value spread is great, chances are good that the dealer will pick a third card which is in between the first two cards in value, and therefore a winner for the player. When a "pair" is drawn, a player is anticipating a big win if the dealer draws a third identically valued card, resulting in an eleven to one payoff of the original bet. The control theory in producing a sensor system for Acey Deucy is relatively the same as with Blackjack, with the only differences being as a result of the differences in interactive card variations between the two games. In other words, the dealer's display of the first two cards will activate the perimeter detection system, parts of which will be deactivated only when the dealer directs his attention to a particular player as appropriate.

While various proximity detectors can be used in the cheating detection systems of the invention, as indicated above, a presently preferred system makes use of capacitative detectors. Such detectors can be linked in a system by an electronic circuit such as shown in FIG. 8, in which the individual circuit elements have the characteristics shown in Table A. These electronic elements are electromechanical switches and the like. However, it will be understood that a completely solid state control system can be designed.

FIG. 9 shows these elements with the circuit elements superimposed upon a blackjack type casino table in order to more easily illustrate the entire electronic system. The overall system may be activated from a switch, not shown, which may be positioned in a location to be operated by overseeing personnel at a remote location. Thereafter, the system as a whole will be activated. None of the sensors or detectors other than DD at the dealer's position will be activated, however. In such system, therefore, for example, the interposition of the dealer's hand in proximity to the capacitative detector P11, which is hidden under the table directly under the face up card position at the dealer's location (DC shown on Line 2 of FIG. 8) will trip the relay DC normally open contacts at Line 4 which will activate the entire system, so that any movement in front of the various player position sensors N1 through N8 will activate the signal indicators or generators C1 through C8, displayed on Lines 5 through 28 of FIG. 8., and through appropriate circuits (not shown) ultimately provide an alarm, or whatever the signal may be, at a remote location to indicate movement detected at any of these positions during the time the detectors are activated. Therefore, the entire system is activated with the placement of the dealer's first card, and remains active through the remainder of the deal.

Figure 8:
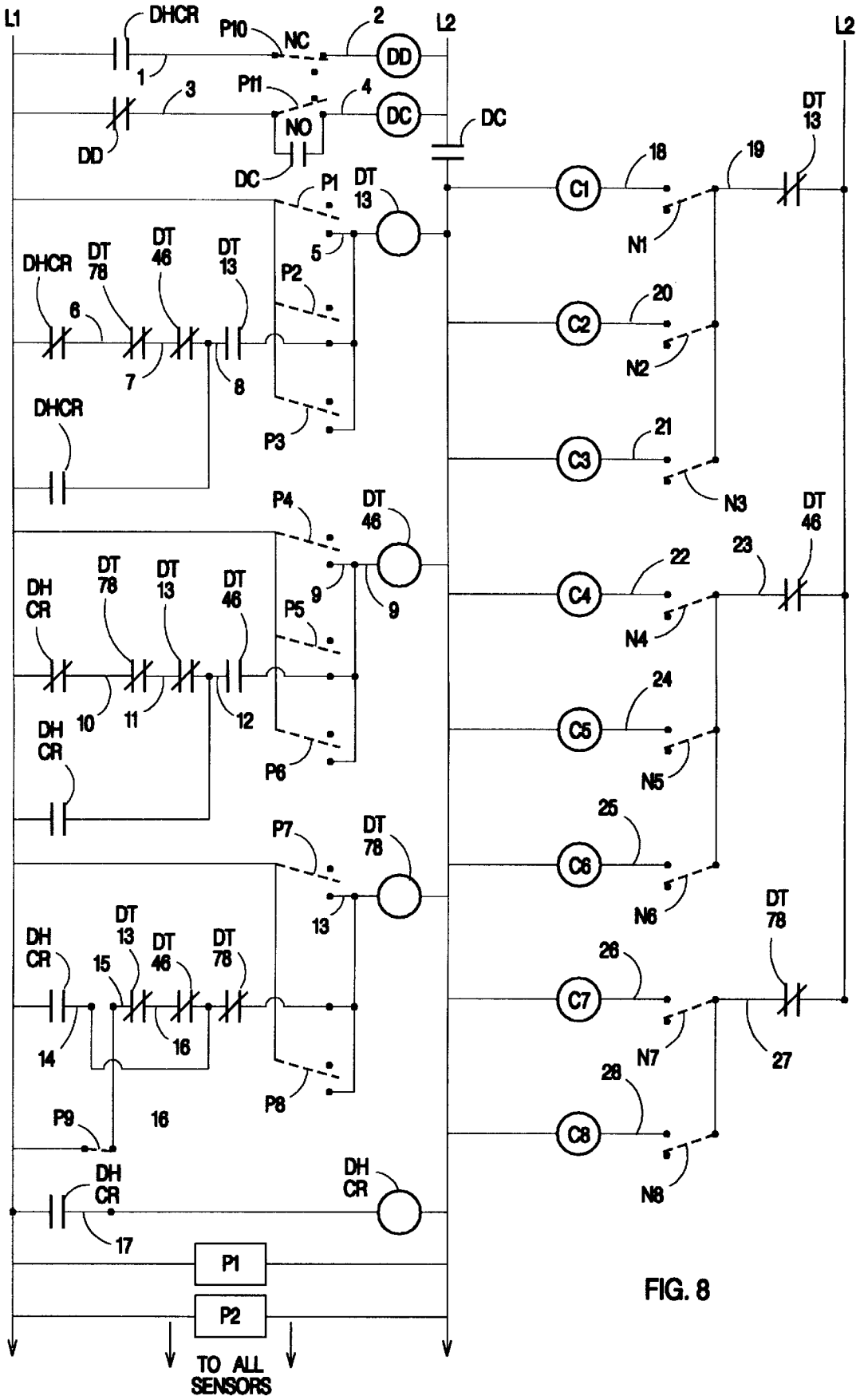
FIG. 8 is a circuit diagram an embodiment of the system of the invention as it is used with a blackjack type casino game table.

The wiring diagram of FIG. 8 demonstrates a control theory which contains three distinct groupings of players, namely players 1 through 3, 4 through 6, and the last group represented by players 7 and 8. These groupings are associated with the dealer trip relays DT13 (players 1 through 3), DT46 (players 4 through 6) and DT78 (players 7 and 8), which control the activation and deactivation of the player sensors N1 through N8. The present inventors have found that a wiring diagram incorporating these groupings of players is a sufficient way to demonstrate the effect of the invention without the production of an overcrowded wiring diagram. The number of relays and the type of control theory is limited only by the associated cost, and the present inventors do not intend to limit the design of the control structure to that of FIG. 8, but intends merely to demonstrate the operation of the invention in accordance with one particular control theory. Other control theories are demonstrated in Tables 3 through 6 previously discussed.

The electromagnetic relays of the present invention have a 24 volt coil supplied by a 120 volt to 24 volt transformer alternating current, then converted to direct current voltage by means of a 4 diode bridge. The present inventors understand that the relays may be solid state, an op amp, or solid state control relay (SCR) monitoring amps. The present inventors, realizing that the sensors may operate on almost any voltage, preferred to operate with 24 volts direct current because of the safety and because anything lower wouldn't be as effective in response to the required "sensing" distance and potential environmental hazards which may impair the "sensing" effectiveness.

The sensors are physically located underneath the surface of a gaming table, and therefore the voltage must be high enough so that dirt and other incidental conditions would not impair the sensor's effectiveness. The sensitivity of the sensors, and therefore the scope and range of the electromagnetic sensing field, may be adjusted depending on the demands of the casino. The sensing field height may encompass merely a single chip, or it may encompass a stack of fifteen chips. If the field is not large enough to accommodate a sizeable stack of chips, then a player would be able to add or subtract chips from the top of the stack, which would be above the range of the sensing field, without triggering the sensor. Obviously, the strength and range of the sensor's field will be directly related to the type of sensor used, and the amount of power required to effect that particular range and field. The present inventors have found that a sensor field of approximately two inches in height and diameter should be sufficient. All sensors operate between 10 and 65 VDC, and the present inventors chose 24 VDC because of the availability of associated equipment necessary to operate the device of the present invention, i.e. bulbs, contactors and power supplies.

The dealer initiates a round of play after all of the players have placed their initial wagers ("antes"). The wiring diagram of FIG. 8 illustrates that only the first two lines have power, while the remaining lines are without power due to the open "DC" relay contact exhibited on Line 4 of the wiring diagram. The "DC" relay is located on Line 2, and is expressed by the letters "DC" in a circle. Once the "DC" relay is energized, the normally open contactor on Line 4 will close, and the device of the present invention will be ready for use.

The dealer distributes one card to each player, and then deals one card to himself or herself. Depending on the particular casino, the dealer's first card with either be face-up or face-down. Regardless of whether the dealer's first card is face-up or face-down, the interposition of the dealer's hand, during the placement of the dealer's first card, over the sensor P11 (Line 2) triggers the sensor P11 and energizes the "DC" relay (Line 2). When the DC relay is energized, the normally closed contacts shown on Lines 3 and 4 become closed, and the entire device of the present invention becomes operational.

The left side of the wiring diagram of FIG. 8 displays the dealer sensors designated P1 through P11. The right side of the wiring diagram of FIG. 8 displays the player sensors, designated N1 through N8, and the signal indicators or generators designated C1 through C8. The sensors N1 through N8 are negatively energized, illustrated by their placement on the wiring diagram, and therefore the sensors P1 through P8 are positively energized. The present inventors decided upon both negatively and positively energizing sensors based on availability, and recognizes that any sensor may be used regardless of the type of energizing. The signal indicators or generators C1 through C8 may result in visual or audible signals, or merely electronic signals which are communicated to a central monitoring system. With reference to FIG. 2, the symbols of FIG. 8 are correlated as follows: the player sensors N1 through N8 in FIG. 8 are the same as the player position sensors 201 through 208 of FIG. 2, the dealer sensors P1 through P8 in FIG. 8 are the same as the dealer sensors 401 through 408 of FIG. 2, dealer sensor P9 in FIG. 8 is the same as sensor 500 in FIG. 2, dealer sensor P10 in FIG. 8 is the same as sensor 600 in FIG. 2, and dealer sensor P11 in FIG. 8 is the same as sensor 501 in FIG. 2, signal indicators or generators C1 through C8 in FIG. 8 are represented altogether by reference numeral 900 in FIG. 2. Table A further illustrates the description of the different components of the wiring diagram of FIG. 8.

The dealer now must address each player in turn, proceeding in a clockwise fashion around the table from player number 1 to the dealer's immediate left to player number 8 to the dealer's immediate right. Operation of the device of the present invention is not dependent on a full table of players. Each dealer trip relay is triggered by the placement of the dealer's hand on one of the dealer sensors P1 through P8, and movement over a particular sensor does not have to be done in order from the first player to the last, although the device of the present invention is intended to accommodate from a full table to merely one player.

The action of the dealer addressing the first player at a table, or in other words the placement of the dealer's hand over the first dealer sensor P1 (Line 5), will trigger the dealer trip relay DT13 (Line 6). FIG. 8. also demonstrates on Lines 7 and 11 that the DT13 relay may also be energized by the dealer crossing over and triggering the sensors P2 or P3. The energizing of relay DT13, through the interposition of the dealer's hand over either P1, or P2, or P3, renders the first three player signals C1 (Line 5), C2 (Line 8) and C3 (Line 12) ineffective since N1 (Line 5), N2 (Line 9) and N3 (Line 12) are rendered inoperable through the change in character of the DT13 relay pins demonstrated on Line 5. Energizing of the DT13 relay allows interaction between the dealer and the first three players, while the remaining player sensors remain activated through the normally closed contact of relay DT46 (Line 15) and the normally closed contact of relay DT78 (Line 24).

When the dealer addresses player 4 by pointing to player 4's cards and triggering sensor P4 (Line 13), relay DT46 (Line 14) becomes energized, and this could also occur through the interposition of the dealer's hand over sensor P5 (Line 16) or sensor P6 (Line 19), i.e. if the dealer addresses player 4 or player 5 or player 6. The energizing of the DT46 relay (Line 14) cuts off the power to the DT13 relay (Line 9) thereby making C1, C2, and C3 operative again. Also, the energizing of the DT46 relay (Line 14) renders C4 (Line 15), C5 (Line 19) and C6 (Line 23) inoperable because current is no longer able to flow to the sensors N4 (Line 15), N5 (Line 19) and N6 (Line 19), and this is because the energizing of the DT46 relay opens the normally closed contacts of the DT46 relay (Line 15). Rendering the signal indicators or generators C4, C5, and C6 inoperable and the sensors N4, N5 and N6 inoperable allows the dealer to interact with player 4 and/or 5 and/or 6 while the remaining "N" sensors remain activated to monitor the other player positions.

When dealer addresses player 7 and/or 8 by pointing to his or her cards, the interposition of the dealer's hands over the P7 (Line 21) or P8 (Line 26) sensor energizes the DT78 relay (Line 23). The energizing of the DT78 relay (Line 23) cuts off the power to the DT46 relay (Line 17) thereby making C4, C5, and C6 operative again. Also, the energizing of the DT78 relay (Line 23) renders C7 (Line 24) and C8 (Line 27) inoperable because current is no longer able to flow to the sensors N7 (Line 24) and N8 (Line 27), and this is because the energizing of the DT78 relay opens the normally closed contacts of the DT78 relay (Line 24). Rendering the signal indicators or generators C7 and C8 inoperable and the sensors N7 and N8 inoperable allows the dealer to interact with player 7 and/or 8 while the remaining "N" sensors remain activated to monitor the other player positions.

The previous discussion illustrates a dealer's progression around a gaming table during the actual play of the game. The dealer proceeds clockwise from the player 1 position to the player 8 position and this is illustrated on FIG. 8 from Line 5 down to Line 26 of the circuit diagram. The control theory of the "DT" relays exhibited on Lines 9, 17 and 24 of FIG. 8 illustrate an important aspect of the device of the present invention. After the dealer has dealt the players' cards and before the dealer addresses any player, the normally closed contacts of each "DT" relay (Lines 5, 15 and 24), which control the activation of the players' sensors N1 through N8 and the signal indicators or generators C1 through C8, are in their normally closed position indicating activation of all of the players' sensors, while the normally open contacts of each "DT" relay (Lines 9, 17 and 24), which govern the activity of and the response from the dealer sensors P1 through P8, are in their normally open position indicating readiness of all of the dealer sensors.

The energizing of DT13, through the activation of sensor P1, P2 or P3, closes the circuit at Line 9, but provides an opening at Lines 5, 17 and 24 (the energizing of a relay changes the character of each contactor from open to closed and vice versa). The opening at Line 5 renders the first three player sensors N1 through N3 and the first three signal indicators or generators C1 through C3 inoperable. The opening at Lines 17 and 24 makes it impossible to seal the DT46 or DT78 relay, which in turn maintains the operability of the player sensors N4 through N8 and the signal indicators or generators C4 through C8. Progressing forward, the energizing of DT46, through the activation of sensor P4, P5 or P6, closes the circuit at Line 17, but provides an opening at Lines 9, 15, and 24. The opening at Line 15 renders the second three player sensors N4 through N6 and the second three signal indicators or generators C4 through C6 inoperable. The opening at Line 9 returns all of the DT13 contacts to the original position, thus the circuit at Line 17 allows for complete current flow, since DT13 is now closed, and N1 through N3 (and therefore C1 through C3) become operable again. The opening at Lines 9 and 24 makes it impossible to seal the DT13 or DT78 relay, which in turn maintains the operability of the player sensors N1 through N3, N7 and N8 and the signal indicators or generators C1 through C3, C7 and C8. Progressing forward, the energizing of DT78, through the activation of sensor P7 or P8 closes the circuit at Line 24, but provides an opening at Lines 9, 17, and 24. The opening at Line 24 renders the last two sensors N7 and N8 and the last two signal indicators or generators C7 and C8 inoperable. The opening at Line 17 returns all of the DT46 contacts to the original position, thus the circuit at Line 24 allows for complete current flow, since DT46 is now closed, and N4 through N6 (and therefore C4 through C6) become operable again. The opening at Lines 9 and 17 makes it impossible to seal the DT13 or DT46 relay, which in turn maintains the operability of the player sensors N1 through N6 and the signal indicators or generators C1 through C6. This control theory illustrates how the device of the present invention can operate with anywhere from a single player to a full table. Each dealer "P" sensor does not have to be triggered in order to progress to the next dealer "P" sensor, and therefore, the device of the present invention will operate regardless of whether the dealer starts with player 1, or player 4, or player 7.

After the dealer has addressed each player in turn, and all of the players are satisfied with respect to their final positions and bets, the dealer reveals his or her face-down card and plays out his hand. When the dealer turns over the face-down card, he or she passes over sensor P9 (Line 26) which energizes the DHCR relay (Line 28) which effects the normally open DHCR contacts at Lines 1, 11, 19, 24 and 28 (which are energized closed) and the normally closed contacts at Lines 9 and 17 (which are energized open). By crossing over P9 (Line 26), the energizing of the DHCR relay deactivates DT78 (Line 23) by opening up the circuit at Line 26, and therefore C7 (Line 24) and C8 (Line 27) are again rendered operable. As the dealer finishes his/her hand, all of the player sensors N1 through N8 and all of the signal indicators or generators C1 through C8 are operational, which is critical to the device of the present invention, since the dealer's focus is on his or her hand, and not on the players.

Once the dealer's hand is determined, the dealer must payout those players who won, and collect from those players which lost. The conventional way the dealer addresses each player during the payout and collection process is in reverse order to that of the normal betting and playing stage, i.e. starting with the last player (player 8) and ending with the first player (player 1). It must be remembered that immediately before the dealer begins to payout or collect from each player, all of the player sensors N1 through N8 are operational, and this is due to the energizing of the DHCR relay on Line 28.

When the dealer addresses player 7 or player 8, he or she will cross over sensor P7 (Line 21) or P8 (line 26), and through the resultant energizing of the DT78 relay (Line 23), player sensors N7 (Line 24) and N8 (Line 27) and signal indicators or generators C7 (Line 24) and C8 (Line 27) are rendered inoperable, and will remain inoperable until the system of the device of the present invention is reset. Essentially, once the player has received his or her winnings, or lost his or her wager, there is no need for any further monitoring since the player's wager, which is now nonexistent, is no longer capable of being modified.

After dealer pays or collects from players 7 and 8, he/she will collect or pay players 4,5 and/or 6. When the dealer crosses over sensor P6 (Line 20), P5 (Line 17) or P4 (Line 13), and through the resultant energizing of the DT46 relay, player sensors N6, N5 and N4 as well as signal indicators or generators C6, C5 and C4 are rendered inoperable and will remain that way until the system of the present invention is reset. It should be noted that the energizing of the DT46 relay will not result in the de-energizing of the DT78 relay, and this is illustrated in the wiring diagram of FIG. 8 on Lines 24 and 25, where the now-closed DHCR contactor on Line 24 provides for the current flow around the now-opened DT46 relay contactor (resulting from the energizing of the DT46 relay). Therefore, when the dealer has finished paying or collecting from players 8 through 4, those player sensors and respective signal indicators or generators will remain inoperable until the system of the device of the present invention is reset. The combination DHCR relay contacts (Lines 9 and 11, Lines 17 and 19, and Lines 24 and 26) associated with each dealer trip relay provides the different control theory during the payout/collection stage of the game.

After dealer pays or collects from players 4, 5 and/or 6, he/she will collect or pay players 1 and/or 2 and/or 3. When the dealer crosses over sensor P3 (Line 11), P2 (Line 7) or P1 (Line 5), and through the resultant energizing of the DT13 relay, player sensors N3, N2 and N1 as well as signal indicators or generators C3, C2 and C1 are rendered inoperable and will remain that way until the system of the present invention is reset. After the last player is handled by the dealer, all of the "DT" relays remain energized, while all of the player sensors N1 though N8 and signal indicators or generators C1 through C8 remain inoperable.

After dealer pays or collects from each player at the table, he or she will gather up all cards on the table, including the dealer's own cards, and place them in the discard rack. When the dealer places all of the discarded cards in the discard rack, the dealer will trigger, or cross over, sensor P10

(Line 1) and energize the DD relay (Line 1), which will in turn open the normally closed contactor of the DD relay on Line 2, thereby de-energizing the DC relay (Line 2) and the entire system will shut down due to the now-open DC relay contactor on Line 4. A new round of play will start after the players have placed their bets, the dealer has dealt the cards, and activated the system by dealing his or her first card which, as previously described, triggers sensor P11 which energizes the DC relay which closes the normally-open DC contactor at Line 4 allowing for current to flow to the rest of the system.

An activated system with all of player sensors N1 through N8 being operational provides the greatest possible protection to a casino. Any movement at or about any of the player sensors N1 through N8 when such sensors are operational will activate the appropriate signal indicators or generators C1 through C8 (Lines 5, 8, 12, 15, 18, 22, 24, or 27) and alert a person or system at a remote location so that security personnel, or an alternative monitoring device, can have their attention directed to the table and player in question. The signal indicators or generators C1 through C8, as previously discussed with respect to the monitoring system 900, can correlate to a visual, audible, computer generated monitoring display or system, or any other system decided upon by the casino.

The electronic circuit diagram and noted components of FIGS. 8 and 9 constitute the presently preferred arrangement of Applicant's detection system for a blackjack type casino table at the present time, but will be understood to be only one of a number of similar or related embodiments of the invention which can be constructed and to be illustrated as only one presently preferred embodiment for a single game, where the detection system of the invention is particularly useful.

Figure 10:
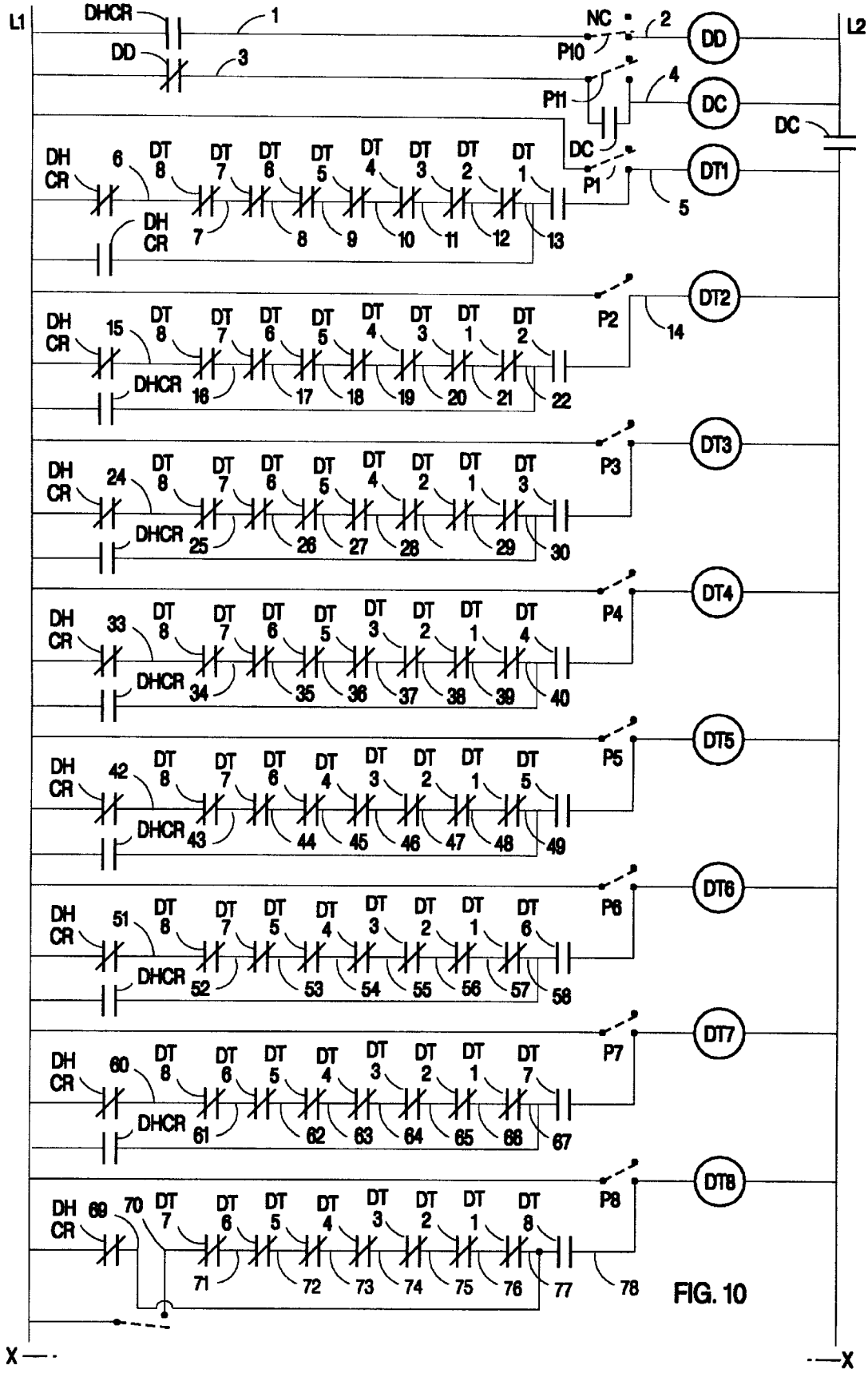
FIG. 10 is a circuit diagram FIG. 10A being a continuation of FIG. 10, of an alternative embodiment of the system of the invention as it is used with a blackjack type casino game table.
Figure 10A:
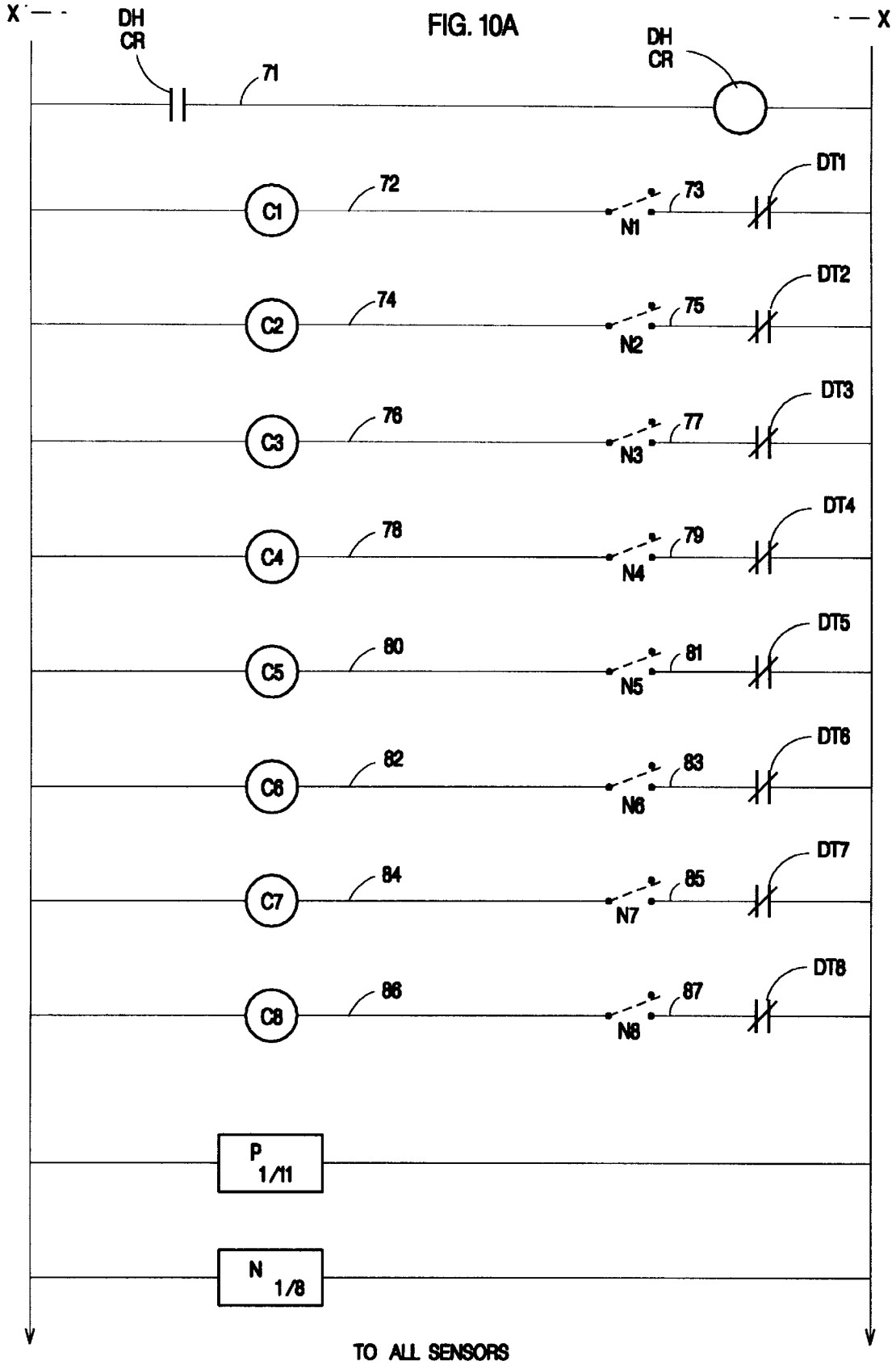

FIG. 10 is a wiring diagram, which is continued in FIG. 10A and is similar to that of FIG. 8, of an embodiment of a system of the device of the present invention which operates on a control theory similar to that previously described in Table 3. Whereas FIG. 8 demonstrated sensor arrangements for three different groupings of players, namely players 1 through 3, 4 through 6, and 7 and 8, FIGS. 10 and 10A illustrate a sensor and relay location arrangement for each individual player. Whereas FIG. 8. had three relays for the three groupings of players, namely DT13 for the first three players, DT46 for the second three players, and DT78 for the last two players, FIGS. 10 and 10A display a relay for each player, i.e. DT1 through DT8 while keeping the same dealer sensors and relays. FIGS. 10 and 10A illustrate a control theory whereby the dealer only renders that addressed player's sensor inoperable, which means that the dealer only has to focus on one player at a time as opposed to three players at a time. FIGS. 10 and 10A illustrate a system where the dealer doesn't have to rely on his or her peripheral vision as much as with the system of FIG. 8, since the only player of concern is the player immediately being addressed by the dealer.

The present inventors realize that the different combinations of control theories with respect to the different number of player sensors and relays is too numerous to describe. FIGS. 8, 10 and 10A illustrate the wiring diagrams and electrical descriptions of only two control scenarios. An electronics engineer or technician will, by reference to these circuit diagrams, be readily able to provide an operating circuit in accordance with invention as diagrammed in FIGS. 8, 10 and 10A and Table A.

As will be recognized from the foregoing disclosure and appended drawings, the present invention provides an extremely useful and efficient system for detecting unauthorized moves and changes to their wagering by gamblers in casino games where large scale losses tend to occur due to such cheating by both casual and professional gamblers. The system of the invention not only is not normally detectable by the public in a casino, but is also not detectable by the dealers themselves, except inferentially, and even then, its exact operation and times of operation are not readily ascertainable by casino personnel, tending therefore to keep such personnel honest and, even more important, to inhibit their cooperation with organized crime figures and the like. The automatic operation, and particularly the undetectability of the system, tends to keep those who might otherwise be corruptible from being corrupted either by greed or by possible threats by others, who, realizing that a dealer, for example, may not be able to readily aid them to cheat, may be more likely not to threaten a dealer to win his or her cooperation.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

TABLE A

Reference to FIG. 8 Control Circuit Diagram

| Reference Character | Description | Electrical Specification |
|---|---|---|
| DHCR | Dealer hole card | Electromagnetic relay with normally open and normally closed contacts. |
| DD | Dealer discharge | |
| DC | Dealer's first card | |
| DT13 | Dealer trip 1 through 3 | |
| DT46 | Dealer trip 4 through 6 | |
| DT78 | Dealer trip 7 and 8 | |
| P1–P8 | Dealer positions 1 through 8 | Sensor |
| P9 | Dealer's hole card | |
| P10 | Dealer discharge | |
| P11 | Dealer first card | |
| C1–C8 | Signal indicator or generator (light, tone, etc.) | Signal |
| N1–N8 | Player positions 1 through 8 | Sensor |

We claim:

1. An unauthorized movement detection system for casino tables comprising:

a. a movement detection device adjacent a dealer's card position at a casino table to detect an activating movement of the dealer, b. movement detection devices adjacent a plurality of player positions on the opposite side of the casino table from the dealer's position, c. said movement detection devices adjacent the players' positions having the capability of detecting movement of both the player in a forbidden zone and the dealer adjacent each player, d. coordinating electrical means linking the various detectors such that movement at the dealer's position will activate the various detectors at the players' positions to detect movement there adjacently, e. circuit means to deactivate player detectors where dealer movement adjacent player positions is detected and to reactivate such player detectors when dealer movement is detected adjacent other player positions, and f. circuit means to provide a detection signal to an appropriate monitoring system when movement is detected at a player position while player detection devices are activated.

2. An unauthorized movement detection system for casino tables in accordance with claim 1 wherein the movement detection devices adjacent the players positions are of two kinds, one detecting movement of the players and one detecting movement of the dealer, wherein the detectors detecting movement of the dealer are arranged to deactivate the detectors for detecting movement of the players.

3. A cheating detection system for casino tables comprising:

a. a casino table, b. a plurality of movement detectors associated with the casino table, c. the detectors being positioned to detect movement at the surface of said casino table in a patterned sequence such that unauthorized movement is detected, and d. means to signal unauthorized movement detected by the detectors to a security monitoring system.

4. A cheating detection system in accordance with claim 3 wherein the detectors are capacitance type movement detectors.

5. A cheating detection system in accordance with claim 4 wherein the detectors are positioned adjacent player positions at said casino table and dealers positions at said tables.

6. A cheating detection system in accordance with claim 5 wherein there are a first set of detectors adjacent the players for detecting movement of the players toward a secure zone and a second set of detectors adjacent the players on the dealer's side for detecting movement of the dealer in addressing the players individually.

7. A cheating detection system in accordance with claim 6 wherein the second set of detectors are arranged in a circuit to deactivate the corresponding first set of detectors upon an address movement of the dealer.

8. A casino table device for the monitoring and detection of movement on a casino table comprising:

a. a first movement sensor means located underneath the dealer's face-up card position on the casino table, b. a second movement sensor means located underneath each player's chip betting area on the casino table, c. a third movement sensor means located between each player's chip betting area and the dealer's card area on the table, and d. means to monitor movement over each sensing means to alert a casino security system when unauthorized movement is detected within either the first, second or third sensing means, e. the monitoring means capable of monitoring several casino tables at one time.

9. A casino table device for the monitoring and detection of movement on a casino table in accordance with claim 8 wherein each sensing means further comprises a capacitance-based sensor.

10. A casino table device for the monitoring and detection of movement on a casino table in accordance with claim 8 wherein each sensing means further comprises an infrared-based sensor.

11. A casino table device for the monitoring and detection of movement on a casino table in accordance with claim 8 wherein the monitoring means further comprises an audible alarm which is communicated to the casino.

12. A casino table device for the monitoring and detection of movement on a casino table in accordance with claim 8 where the monitoring means further comprises a visible signal which is communicated to the casino.

13. A casino table device for the monitoring and detection of movement on a casino table in accordance with claim 8 where the monitoring means further comprises an electronic signal which is read by a computer for the central monitoring of several tables at once.

14. A method of detecting cheating at casino tables comprising:

a. detecting movement adjoining the table top adjacent player positions during play at certain positions, b. determining whether such detected movement is dealer movement or player movement, c. using dealer detected movement to activate player movement detectors, and d. signalling player movement detected by activated player detectors to a security monitoring system.

15. A method of detecting cheating at casino tables in accordance with claim 14 wherein the dealer movement is detected between the players and the dealer by capacitance-type detector apparatus.

16. A method of detecting cheating at casino tables in accordance with claim 15 wherein the player movement is detected between the player and player bet positions on the casino table.

* * * * *